US009719503B2

(12) United States Patent
Konishi

(10) Patent No.: US 9,719,503 B2
(45) Date of Patent: Aug. 1, 2017

(54) PUMPING APPARATUS

(76) Inventor: Satoshi Konishi, Tokyo (JP)

( * ) Notice: Subject to any disclaimer, the term of this patent is extended or adjusted under 35 U.S.C. 154(b) by 536 days.

(21) Appl. No.: 13/560,591

(22) Filed: Jul. 27, 2012

(65) Prior Publication Data

US 2013/0064701 A1 Mar. 14, 2013

(30) Foreign Application Priority Data

Sep. 12, 2011 (JP) ..... 2011-197874

(51) Int. Cl.
*F04B 43/14* (2006.01)
*F04B 43/08* (2006.01)
*F04B 43/12* (2006.01)

(52) U.S. Cl.
CPC ..... *F04B 43/14* (2013.01); *F04B 43/082* (2013.01); *F04B 43/1223* (2013.01)

(58) Field of Classification Search
CPC ..... F04B 43/14; F04B 43/082; F04B 43/1223
USPC ..... 417/474–477.4; 604/153; 251/4, 7–10
See application file for complete search history.

(56) References Cited

U.S. PATENT DOCUMENTS 1,611,451 A * 12/1926 Jembrzycki ..... 401/278
4,501,405 A * 2/1985 Usry ..... 251/7
4,936,760 A 6/1990 Williams
5,151,019 A 9/1992 Danby et al.
5,511,951 A * 4/1996 O'Leary ..... 417/53
5,842,841 A 12/1998 Danby et al.
6,013,057 A 1/2000 Danby et al.
6,123,524 A 9/2000 Danby et al.
6,129,517 A 10/2000 Danby et al.
6,195,887 B1 3/2001 Danby et al.
6,213,738 B1 4/2001 Danby et al.
6,234,773 B1 * 5/2001 Hill et al. ..... 417/474
2003/0017066 A1 * 1/2003 Danby et al. ..... 417/474
2007/0048161 A1 3/2007 Moubayed
(Continued)

FOREIGN PATENT DOCUMENTS

JP H11-508017 A1 7/1999
JP 2003-049779 A1 2/2003
(Continued)

OTHER PUBLICATIONS

Extended European Search Report (EESR) issued by the European Patent Office, mailed Jan. 14, 2013, for European counterpart Application No. 12183725.6.

*Primary Examiner* — Peter J Bertheaud
*Assistant Examiner* — Dnyanesh Kasture

(57) ABSTRACT

The present invention provides such pumping apparatuses that have very little deviation and high stability in pumping flow. A pumping apparatus comprises two members that are set along a longitudinal direction of a tube made of an elastic material with a relation that the space formed by grooves made in the two members holds the tube. The two members have reciprocal motion such that at least one of the two opposing members shuttles in parallel with the other opposing member and has a move-in motion such that at least one of the two opposing members vertically moves to the opposing surfaces of the other opposing member so that surrounding part of the groove thereof moves into an inner space of the groove of the other opposing member, by which motion the liquid in the tube is discharged from the tube by the deformation of tube cross sectional shape.

16 Claims, 40 Drawing Sheets

(56) References Cited

U.S. PATENT DOCUMENTS

| | | | | |
|---|---|---|---|---|
| 2011/0158823 | A1* | 6/2011 | Wang et al. | 417/53 |
| 2012/0138832 | A1* | 6/2012 | Townsend | 251/251 |

FOREIGN PATENT DOCUMENTS

| | | | |
|---|---|---|---|
| JP | 2003-113782 | A1 | 4/2003 |
| JP | 2003-254260 | A1 | 9/2003 |
| JP | 2003-286959 | A1 | 10/2003 |
| JP | 4511388 | B2 | 7/2010 |
| WO | 9737703 | A | 10/1997 |

* cited by examiner (a)

(b)

(c)

(a)

(b)

(c)

(a)

(b)

(c)

(a)

(b)

(c)

(a)

(b)

PUMPING APPARATUS

BACKGROUND OF THE INVENTION

1. Field of the Invention

The present invention relates to a pumping apparatus that deforms cross-sectional shape of a tube made of an elastic material and discharges fluid filled therein.

2. Related Art

A pumping apparatus that discharges the fluid which is filled in a tube made of an elastic material (called "an elastic tube" hereinafter) wherein the cross-sectional shape of the elastic tube is deformed therein is well-known as a tube pump. The tube pump comprises a deforming mechanism that deforms the elastic tube in the surface vertical to the longitudinal direction thereof and inlet and outlet valves that occlude and de-occlude (called "relieve" hereinafter) the tube. The inlet valve occludes a portion of the elastic tube, the outlet valve relieves another portion of the tube and the deforming mechanism presses the part of the tube to deform the cross-sectional shape of the tube between these two portions so that the internal space of the tube shrinks to decreasing of cross-sectional area of the tube. The shrinkage of the inner volume of the tube enables to squeeze the fluid filled in the tube to transport it to the outlet valve along the longitudinal direction of the tube (squeezing period). After the squeezing (or transporting) is completed, the inlet valve relieves the occluded portion of the tube, the outlet valve occludes the relieved portion of the tube and the deforming mechanism returns to the position before the squeezing starts and then the fluid is filled into the internal space of the tube with the shape of tube returning to the initial shape posed by the elasticity of the elastic tube. Combining of the mechanical behaviors of tube pressing and returning by the deforming mechanism, tube occluding and relieving by the inlet valve and the outlet valve of a tube pump, it is possible to transport the fluid filled in the tube so that the tube pump, that is a kind of pumping apparatus, discharges the fluid filled in the tube.

Tube pumps are widely used to transport fluid such as liquid and gas in various application. Especially, it is very effective to transport the fluid from a container to another container via tube wherein the fluid needs to be uncontaminated by the external environment. The internal space of the tube, which is a passage of the fluid, being pressed to shrink, the fluid in the tube is transported without directly contacting with any other driving mechanism. Due to this advantage, tube pumps are used for medical infusion pumps that infuse medicine or solution to human bodies, fluid handling tools used for biological laboratories and orthochromatic control pumps to add toning agent to color ink.

Tube pumps can be roughly classified into a tube rotary pump and a peristaltic pumps. The former uses a roller as a tube deforming mechanism and inlet and out valves. Due to the simplicity of the mechanism, the former has been using old established technology and has a lot of varieties of discharge capacity (Reference 1 and 2). The latter uses a peristaltic mechanism as tube deforming mechanism. The mechanism is rather complicate, however the fatigue of tube is less and applicable to small capacity pumps. Among peristaltic pumps, a shuttle pump of which mechanism has a reciprocating motion part (shuttle part) is well-known (Reference 3 to 9).

FIGS. 38(*a*) to 38(*c*) show the principle of pump operation of a conventional pump. These figures show the pump operation described in Reference 4, wherein different numbers and codes from those used in Reference 4 are used.

A shuttle pump 1000 fundamentally comprises a tube 1001, a shuttle mechanism 1002 as a deforming mechanism, an inlet valve mechanism 1003 as an inlet valve and an outlet valve mechanism 1004 as an outlet valve. In the shuttle mechanism 1002, the inlet valve mechanism 1003 and the outlet valve mechanism 1004 synchronously operate. They periodically deform and undeform (or relieve the deformation of) the tube 1001 and transfers the fluid filled in the tube 1001 from the upper stream to the downstream. The region of the tube 1001, which is between the inlet valve mechanism 1003 and the outlet valve mechanism 1004 makes pump operation such as filling and discharging the fluid that flows the tube 1001. This region is called "pump region" hereinafter.

In order to fill the fluid in the pump region of the tube 1001, the inlet valve mechanism 1003 relieves the inlet side of the tube 1001, the outlet valve mechanism 1004 occludes the outlet side of the tube 1001 and the shuttle mechanism 1002 relieves the deformation of the tube 1001, as shown in FIG. 38(*a*). By these motions of mechanism, the fluid is filled in the pump region of the tube 1001.

Subsequently, the outlet side of the tube 1001 is, as shown in FIG. 38(*b*), relieved by the outlet valve mechanism 1004 and the inlet side of the tube 1001 is occluded by the inlet valve mechanism 1003 under the status that the pump region of the tube 1001 in which the fluid is filled. With shrinking of the internal space of the tube 1001 by the shuttle mechanism 1002 that deforms the tube 1001 as shown in FIG. 38(*c*), the fluid filled in the pump region of the tube 1001 is transported to the downstream through the outlet side of the tube 1001 which is relieved by the outlet valve mechanism 1004.

Then, as shown in FIG. 38(*a*), the inlet valve mechanism 1003 relieves the inlet side of the tube 1001, the outlet valve mechanism 1004 occludes the outlet side of the tube 1001 and the shuttle mechanism 1002 undeforms (or relieves the deformation of) the tube 1001. In order to fill the fluid in the pump region of the tube 1001. By this set of motions, the shape of the tube 1001 return to the initial shape and the internal space of the tube 1001 at the pump region increases from that of the shrunk tube shape to that of intrinsic initial tube shape. The incremental volume of the internal space is filled with the fluid supplied from the upper stream of the fluid.

The motion of the inlet valve mechanism 1003 and the outlet valve mechanism 1004 being in synchronous to that of the shuttle mechanism 1002, the fluid filled in the tube 1001 is transported from the upper stream to the downstream by repeating the deformation and undeformation (or relieving the deformation) of the tube 1001 by the shuttle mechanism.

FIG. 39 shows the cross-sectional view of an example of shuttle mechanism adopted in a prior art (Reference 4).

The shuttle mechanism of this example uses a specially-shaped tube 1011 and comprises jaw members 1012 and 1013 which are set in left and right sides of the specially-shaped tube 1011. The jaw members 1012 and 1013 ridge parts 1014 of the specially-shaped tube 1011 are composed at the upper part and the lower part and these parts face against to tuck the specially-shaped tube 1011 therebetween. The direction of tucking which is upper/lower direction in the FIG. 39 is called Y direction.

The jaw members 1012 and 1013 synchronously move in the same direction. The upper part and the low part of the jaw members 1012 and 1013 move mutually in the reverse orientation in Y direction so that both jaw members 1012 and 1013 press the specially-shaped tube 1011 resulting in the inner volume of the specially-shaped tube 1011 in which the fluid is filled to shrink. Valve mechanisms are set in the upper stream line and the downstream of this shuttle mechanism. The fluid filled in the internal space of the specially-shaped tube 1011 does not reversely flow due to the intervention of valve mechanism set in the upper stream and downstream. On the other hand, the fluid filled in the internal space of the specially-shaped tube 1011 is pressed toward the downstream part of the specially-shaped tube 1011 without the intervention of the valve mechanism set in the downstream. The behavior of fluid being pressed turns into the transportation of the fluid filled in the internal space of the specially-shaped tube 1011. The upper and lower parts of the jaw members 1012 and 1013 move in Y direction to de-press (or relieve from pressing) the specially-shaped tube 1011, the specially-shaped tube 1011 returns to the initial shape due to the elasticity and then the internal shape recovers to have the initial volume. In synchronous to this motion, the upper valve mechanism relieves the specially-shaped tube 1011 and the lower valve occludes the specially-shaped tube 1011. Then the fluid is supplied from the upper stream when the specially-shaped tube 1011 returns to the initial shape. By repeating these motions, the flow is transported only towards downstream and overall pumping motion is generated.

FIG. 40 shows the cross-sectional view of a shuttle mechanism of another example of prior arts. This shuttle mechanism is described in Reference 3.

The shuttle mechanism used for this example of prior art comprises two members that deform the tube 1020 of the tube pump. The members 1021 and 1022 mutually move in parallel. The members 1021 and 1022 do not deform the tube 1020 so that the cross-sectional shape is kept as its initial one at one end of the parallel motion as it is, but press the tube 1020 so that the cross-sectional shape is deformed and the internal space of the tube 1020 in which the fluid is filled shrinks at the other end of the parallel motion as shown in FIG. 40. The shrinkage of the internal space of the tube 1020 results into discharging of the fluid filled in the tube 1020 toward the downstream.

The shuttle mechanism as shown in FIG. 39 needs the specially-shaped tube 1011 that requires a ridge line so that the specially-shaped tube 1011 does not digress from the jaw members 1012 and 1013. Therefore a conventional tube that is a hollow tube with round cross-sectional shape is not used for this tube pump. On the other hand, the shuttle mechanism as shown in FIG. 40 needs additional mechanism such that the tube 1020 is set to and unset from the members 1021 and 1022. For this set and unset motion, one of the members 1021 and 1022 should be rotated at an axis in the end part thereof so that an open inlet or outlet space is made and the tube 1020 can slide in the horizontal direction to be set in or unset from the members 1021 and 1022. To realize such motion, a complicated mechanism has to be additionally installed in the shuttle mechanism for the actual pump mechanism.

FIGS. 41(*a*) and 41(*b*) further shows another example of a prior art of the shuttle mechanism. This shuttle mechanism does not need a specially-shaped tube therefore allows to easily set and unset the tube. There it can be said that this shuttle mechanism have a practical implementation as a tube pump.

The shuttle mechanism shown in FIGS. 41(*a*) and 41(*b*) comprise two shuttle members 1031 and 1032 which hold the tube 1030 therebetween and extend along the tube (vertical to the page) in a planar shape. According to the shape of the shuttle viewed from the back side of the tube holding surface, a name "shuttle plate" is used instead of "shuttle member". The shuttle members 1031 and 1032 have grooves 1033 and 1034, respectively. These grooves 1033 and 1034 form a space that stores the tube 1030 without deforming the cross section of the against the tube 1030 when they completely face to the other.

The shuttle members 1031 and 1032 can slide against each other with a gap that keeps certain distance each other in the direction vertical to the direction of sliding thereof (that is, sliding direction) as shown in FIG. 41(*a*). When the shuttle member 1032 slides against the shuttle 1031, the groove 1034 does against the shuttle 1033 and the tube 1030 turns to be pressed to deform. Then the cross section of the tube 1030 deforms and the internal space of the tube 1030 shrinks to decrease so that the fluid filled in the internal space is discharged to the downstream of the tube 1030 with the motion of the valves synchronous to the shuttle members 1031 and 1032.

In the shuttle mechanism shown in FIGS. 41(*a*) and 41(*b*), the tube 1030 is held in the grooves 1033 and 1034 made in the shuttle members 1031 and 1032. The tube setting and holding process (in other words, mounting process) is that the tube 1030 is put into the groove 1033 or 1034 after expanding the gap between the shuttle members 1031 and 1032 and then the gap is narrowed to return the initial gap between the shuttle members 1031 and 1032. Since the grooves 1033 and 1034 are simple shapes, the mounting and dismounting of the tube 1030 into and from the shuttle mechanism can be easily realized and such mechanism for tube mounting and dismounting can be implemented with simple part assembly. Due to this features, this shuttle mechanism is applied to actual volumetric infusion pumps.

Whichever the shuttle mechanisms are, deviation of flow rate in liquid transportation is strongly required to be little. For example, the shuttle mechanism shown in FIGS. 41(*a*) and 41(*b*) works as the shuttle member 1032 horizontally slides along the surface of the shuttle member 1031 in parallel with the keeping consistent gap therebetween and the tube 1030 is pressed to deform as shown in FIG. 41(*b*). This deformation depends on the physical shapes of the grooves 1033 and 1034 and sliding width but not the material of the tube 1030 in principle.

For the other peristaltic pumps, a plurality of mechanical elements that press to deform a tube is adopted to construct the pump mechanism that presses the tube at a plurality of pressing points or portions. Therefore the internal spaces of the tube are determined by the balance between the pressing force by the pump mechanism and the resilience force of the tube. In other words, one tube region that is pressed to deform by the mechanical elements and the other tube region that returns to the initial shape due to resilience alternatively present along the tube. Therefore the volumes of the internal spaces of the tube region vary or deviate by the force balance between pressing and resilience. As the results, the flow rate of the liquid discharged from the pump varies or deviates due to the variation or deviation of the tube materials and the elasticity that depends on the ambient temperature. From these reasons, sufficient precision and stability of the flow rate are hardly obtained.

Example of the conventional peristaltic pumps and shuttle pumps are found in, for example, the following patent documents, all of which are incorporated by reference:

[Patent Document 1] Japanese Patent Application Publication No. 2003-113782

[Patent Document 2] Japanese Patent Application Publication No. 2003-254260

[Patent Document 3] U.S. Pat. No. 4,936,760

[Patent Document 4] U.S. Pat. No. 5,151,019

[Patent Document 5] U.S. Patent Application Publication 2007/0048161

[Patent Document 6] Japanese Unexamined Patent Application Publication No. 11-0508017

[Patent Document 7] Japanese Patent Application Publication No. 2003-049779

[Patent Document 8] Japanese Patent Application Publication No. 2003-286959

[Patent Document 8] Japanese Patent 4511388

BRIEF SUMMARY OF THE INVENTION

1. Problems to be Solved

For shuttle pumps, the internal space of the tube is determined by the physical shape of the shuttle mechanism (that is, the groove 1033 and 1034 of the shuttle member 1031 and 1032, respectively, and the sliding width as sheen in FIGS. 41(*a*) and 41(*b*)). This is the reason why shuttle pumps have better precision and stability of the flow rate in comparison to other peristaltic pumps. However, the fact that the flow rate is determined by the physical shape of the shuttle mechanism implies that the precision of the flow rate highly depends on the mechanical tolerance and time-varying mechanical deformation and wear after assembly.

For shuttle pump as shown in FIGS. 41(*a*) and 41(*b*), for instance, if the gap between the shuttle member 1031 and 1032 is misaligned from the designed alignment due to the assembly error and time-dependent deterioration, then the gap vertical to the sliding direction between the grooves 1033 and 1034 deviates from the original gap so that the pressed deformation of the tube 1030 changes. The cross-sectional shape of the deformed tube 1030 changes and the area of the cross-section of the tube 1030 does as well. Since the volume of liquid discharged from the shuttle pump is given by the product of the length of tube portion that is subject to the deformation and the difference of the areas of the tube before and after the deformations, if the cross-sectional area of the deformed tube varies, the liquid discharged from the shuttle pump varies in proportion to the variation of the deformed cross-sectional area of the tube 1030. Such variation is quite inconvenient to the application for infusion pumps and orthochromatic control pumps.

The present invention can solve these exiting problems and provide such pumping apparatuses that have very little deviation and high stability in pumping flow.

2. First Aspect of the Present Invention

According to the first aspect of the present invention, it is to provide a pumping apparatus comprising two opposing members that are set along a longitudinal direction of a tube made of an elastic material with a relation that opposing surfaces of the two opposing members oppose each other across the tube, and that have grooves each formed on each of the opposing surfaces wherein the grooves meet to form a space that holds the tube in a cross section thereof, wherein the two opposing members have reciprocal motion, of which motion is realized with a shuttle motion such that at least one of the two opposing members shuttles in parallel with an opposing surface of the other opposing member and has a move-in motion such that at least one of the two opposing members vertically moves to the opposing surfaces of the other opposing member in a mutual relation that surrounding part of the groove thereof moves into an inner space of the groove of the other opposing member, between a liquid holding position where a liquid introduced into the tube held in the space is held therein and a liquid discharging position where the liquid introduced into the tube is discharged from the tube of which cross sectional shape is deformed by the two opposing members in the two opposing members in the reciprocal motion.

The reciprocal motion of the two opposing member is preferably realized by a reciprocal drive mechanism that makes both these the shuttle motion and the move-in motion in a synchronous manner.

The pumping apparatus have preferably two opposing members that make the reciprocal motion between two positions that are the liquid discharging position and the liquid holding position in such a manner that the reciprocal motion repeats between the liquid holding position as a center position and each one of two positions of the discharging position. In the center position, two opposing members meet to form a space with the two grooves so that the tube is held or less deformed in a cross section thereof. At the discharging positions, the cross section of the tube is deformed by the two opposing members in the reciprocal motion.

The pumping apparatus have preferably two grooves that have substantially same triangular shapes for their cross sections and form a hollow that has a substantially square shape for cross section and length section along the tube when the two opposing members oppose to meet. At the discharging position, the grooves deform the tube and shrink the area of the cross section of the tube. Pressing force of the opposing members against the tube makes the deformation of the tube. At least one of the grooves has preferably a bump on the surface of the groove in order to deform the cross sectional area of the tube to be shrunk. Pressing force of the bump against the tube also makes the deformation of the tube.

One of the two opposing members of the pumping apparatus preferably has a groove which has substantially triangular shape for the cross section and the other one of the two opposing members has two bumps and a groove which separates these two bumps. The latter opposing member makes pressing force against the tube at the discharging position.

The reciprocal drive mechanism of the pumping apparatus preferably has four arms that link each of the two opposing members to the other via four joints in a linkage in the way that each of the four arms is attached to the two opposing members to be rotatable in a surface vertical to longitudinal direction of the tube and that the two opposing members have the reciprocal motion between the liquid holding position and the liquid discharging position.

The reciprocal drive mechanism of the pumping apparatus further has a guiding member that guides one of the two opposing members in a motion to the other opposing member with a guidance in a manner that the guiding member has guiding trenches into which guiding rods attached to one of the two opposing members are put to trace thereof and that the two opposing members have the reciprocal motion between the liquid holding position and the liquid discharging position. In such reciprocal motion, one of the opposing members has a motion that the opposing surface of the opposing member moves both in parallel with and in a direction vertical to the opposing surface of the other opposing member. The guiding rods of the reciprocal drive mechanism have rollers therearound to smoothly trace the guiding trenches.

The reciprocal drive mechanism of the pumping apparatus further has a guiding member to which one of the two opposing members with four arms via joints is linked in a linkage that each of the four arms are rotatable in a surface vertical to longitudinal direction of the tube and that the two opposing members have the reciprocal motion between the liquid holding position and the liquid discharging position. In such reciprocal motion, one of the opposing members has a motion that the opposing surface of the opposing member moves both in parallel with and in a direction vertical the opposing surface of the other opposing member.

The pumping apparatus has a supporting member to which the opposing member of the reciprocal drive mechanism is mounted has an axle parallel to surface thereof and the other opposing member turns around the axle in a surface vertical to longitudinal direction of the tube in a hinge motion against one of the opposing members to open or close the space that holds the tube in a cross section thereof. The hinge motion implies that one of two planes rotates with an axel that is the line crossing the plane and the other plane or the line parallel to such line and then the angle of the plane to the other plane changes. When the angle increasingly and decreasingly changes, the plane opens and closes in a sense of hinge motion, respectively. In the hinge motion, the opposing member and the other opposing member of the reciprocal drive mechanism composes one plane and the other plane, respectively. The supporting member composes the line crossing the plane and the other plane or the line parallel to such line. The axle around which other opposing member turns in the surface vertical to thereof is the axle that composes the line crossing the plane and the other plane or the line parallel to such line. The motion that the other opposing member turns around the axle in a surface vertical to longitudinal direction of the tube composes the rotation that is one of two planes rotates with an axel that is the line crossing the plane and the other plane or the line parallel to such line. As the result that the other opposing member turns around in a surface vertical thereto and the angle between the two opposing members changes, the other opposing members opens or closes in a sense of hinge motion.

The reciprocal drive mechanism of the pumping apparatus comprises a transmission rod that is attached onto a reverse side of one of the opposing member facing to the other one of the opposing members, a guiding member that has an opening and a rotary cam being held therein and driven by a motor, that has a trench eccentrically made to rotational axis thereof, wherein the transmission rod is put in the trench through the opening by which rotational motion of the rotary cam is converted to linear motion to generate reciprocal motion of one of the opposing member movable against the other one of the opposing member.

The pumping apparatus further comprises valve means that are placed both sides of the reciprocal drive mechanism and occludes and relieve the tube wherein a periphery of the rotary cam has guiding trenches that control the valve means to synchronously occlude and relieve the tube to the reciprocal motion.

3. Second Aspect of the Present Invention

According to the second aspect of the present invention, it is to provide a pump apparatus comprising valve means that occludes and relieve a tube made of an elastic material in at least two positions and pressing means that is placed between the two positions of the tube and press the tube of which cross sectional area is deformed thereby, wherein the pressing means has two opposing members opposing across the tube along longitudinal direction of the tube and two opposing members have grooves formed on each of opposing surface thereof and meet to form a space that holds the tube in a cross section thereof, wherein the two opposing members have reciprocal motion, of which motion is realized with a shuttle motion such that at least one of the two opposing members shuttles in parallel with an opposing surface of the other opposing member and has a move-in motion such that the at least one of the two opposing members vertically moves to the opposing surfaces of the other opposing member in a mutual relation that surrounding part of the groove thereof moves into an inner space of the groove of the other opposing member, between a liquid holding position where a liquid introduced into the tube held in the space is held therein and a liquid discharging position where the liquid introduced into the tube is discharged from the tube of which cross sectional shape is deformed by the two opposing members in the reciprocal motion.

According to the present invention, two opposing members has a reciprocal motion between a liquid holding position where a liquid introduced into the tube held in the space is held therein and a liquid discharging position where the liquid introduced into the tube is discharged from the tube of which cross sectional shape is deformed by the reciprocal motion in a way that these opposing members shuttle in parallel with an opposing surface and move-in to the other opposing members such that at least one of the two opposing members shuttles in parallel with an opposing surface of the other opposing member and vertically moves in to the opposing surfaces of the other opposing member in a mutual relation that surrounding part of the groove thereof moves into an inner space of the groove of the other opposing member. The reciprocal motion of the pumping apparatus provides good accuracy of pumping speed with very little deviation and high stability in pumping flow.

BRIEF DESCRIPTION OF THE DRAWINGS

FIG. 1(*b*) is a schematic illustrating the pumping apparatus of the first embodiment of the present invention wherein the tube is deformed by the shuttle members.

FIG. 1(*c*) is a schematic illustrating the pumping apparatus of the first embodiment of the present invention wherein the tube is deformed by the shuttle members.

FIG. 2(*b*) is a schematic showing a motion of the shuttle members of conventional pumps wherein the tube is deformed to shrink.

FIG. 2(*c*) is a schematic showing a motion of the shuttle members of conventional pumps wherein the tube is deformed to shrink.

FIG. 3(*b*) is a schematic showing another motion of the shuttle members of a conventional pump wherein the tube is deformed to shrinkage.

FIG. 3(*c*) is a schematic showing another motion of the shuttle members of a conventional pump wherein the tube is deformed to shrinkage.

FIG. 4(*b*) is a schematic further showing another motion of the shuttle members of a conventional pump wherein the shuttle members have no move-in motion wherein the shuttle members are at the liquid discharging position.

FIG. 4(*c*) is a schematic further showing another motion of the shuttle members of a conventional pump wherein the shuttle members have no move-in motion wherein the shuttle members are at the liquid discharging position.

FIG. 5(*b*) is a schematic illustrating the pumping apparatus of the second embodiment of the present invention wherein the shuttle members are at the liquid discharging position.

FIG. 5(*c*) is a schematic illustrating the pumping apparatus of the second embodiment of the present invention wherein the shuttle members are at the liquid discharging position.

FIG. 6(*b*) is a schematic illustrating the pumping apparatus of the third embodiment of the present invention wherein the shuttle members are at the liquid discharging position.

FIG. 6(*c*) is a schematic illustrating the pumping apparatus of the third embodiment of the present invention wherein the shuttle members are at the liquid discharging position.

FIG. 7(*b*) is a schematic illustrating the pumping apparatus of the fourth embodiment of the present invention wherein the shuttle members are at the liquid discharging position.

FIG. 7(*c*) is a schematic illustrating the pumping apparatus of the fourth embodiment of the present invention wherein the shuttle members are at the liquid discharging position.

FIG. 38(*b*) is a schematic illustrating a principle of pump operation of a conventional pump wherein the inlet valve mechanism occludes the inlet side of the tube, the outlet valve mechanism relieves the outlet side of the tube and the shuttle mechanism relieves the deformation of the tube.

FIG. 38(*c*) is a schematic illustrating a principle of pump operation of a conventional pump wherein the inlet valve mechanism occludes the inlet side of the tube, the outlet valve mechanism relieves the outlet side of the tube and the shuttle mechanism deforms the tube to transport the fluid filled in the pump region of the tube to the downstream.

FIG. 41(*b*) is a schematic illustrating a cross-sectional view of another example of a prior art wherein the shuttle mechanisms tube is pressed to deform.

DETAILED DESCRIPTION OF THE INVENTION

The embodiments of the present invention is explained in the followings with references of drawings.

1. First Embodiment

Figure 1:
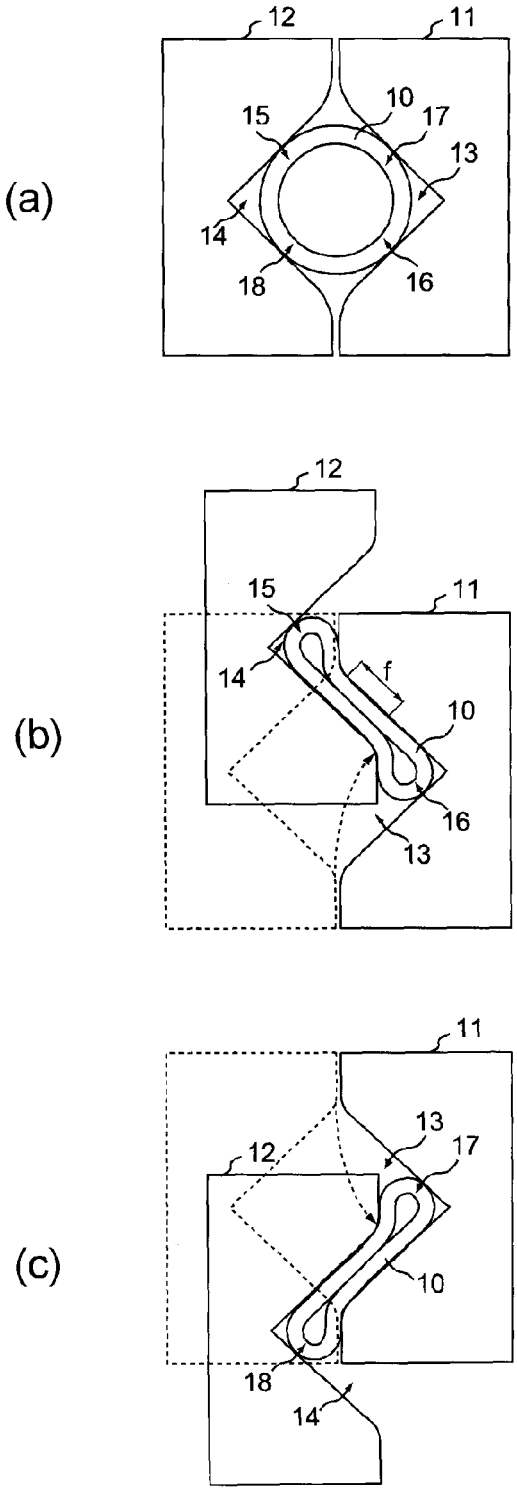
FIG. 1(*a*) is a schematic illustrating the pumping apparatus of the first embodiment of the present invention wherein the maximum area of the cross section of the tube is obtained.

FIGS. 1(*a*) to 1(*c*) are schematics showing the status of pumping apparatus of the first embodiment of the present invention. To discuss the primary features of the present invention, the discussion focuses on the shuttle mechanism (or tube deforming mechanism) and the motion of the pumping apparatus of the present invention.

The pumping apparatus shown in FIGS. 1(*a*) to 1(*c*) is a shuttle pump comprising shuttle members 11 and 12 for two opposing members that oppose each other along the longitudinal direction of tube 10 which is a tube made of an elastic material. The shuttle members 11 and 12 have grooves 13 and 14, respectively, that meet at the opposing surface to conform a space that accommodates the tube 10 in the cross section thereof. The tube 10 is held by the groove 13 formed in the shuttle member 11 and the groove 14 formed in shuttle member 12.

In the first embodiment, the grooves 13 and 14 have substantially same shapes of a triangle and form a substantially square shape in the cross section against the longitudinal direction of the tube 10 when the grooves 13 and 14 meet to oppose.

At least one of the shuttle members 11 and 12 has shuttle motion in parallel with the opposing surface of the other shuttle. The shuttle members 11 and 12 have two specific positions such as a liquid holding position and a liquid discharging position in their mutual positional relation. At the liquid holding position, the grooves 13 and 14 of the members 11 and 12 mutually oppose and form a space that accommodates the tube 10 in their cross sections of the groove 13 and 14 and the status that the liquid is introduced in the tube 10 is held. In following discussion, the liquid holding position (the mutual positional relation of the shuttle members 11 and 12 are shown in FIG. 1(*a*)) is defined as the position where the maximum area of the cross section of the tube 10 that is held by the grooves 13 and 14 is obtained. At the liquid discharging position, the grooves 13 and 14 of the shuttle members 11 and 12 move and the cross sectional shape of the tube 10 is deformed so that the liquid introduced into the tube 10 is discharged from the tube 10. In the following discussion, the liquid discharging position (the mutual positional relation of the shuttle members 11 and 12 are shown in FIGS. 1(*b*) and 1(*c*)) is defined as the position where the liquid discharging from the tube 10 is terminated.

In the shuttle motion, the shuttle members 11 and 12 have reciprocal motion between the liquid holding position as shown in FIG. 1(*a*) and liquid discharging position as shown in FIGS. 1(*b*) and 1(*c*). Two liquid discharging positions come out for both side at the center of the liquid holding position as shown in FIG. 1(*a*) in the reciprocal motion. In other words, the specific positions of the shuttle members 11 and 12 are repeated as the liquid holding position to one of the liquid discharging positions, the liquid discharging position to the liquid holding position, the liquid holding position to the other liquid discharging position and the other liquid discharging position to the liquid holding position.

The shuttle member 11 and 12 move vertically move to the opposing surfaces of the opposing shuttle members 12 and 11, respectively, in the shuttle motion. When the grooves 13 and 14 mutually shift, in other words, in the transition of the liquid holding position to the liquid discharging position, a surrounding part of one of the grooves 13 and 14 has move-in motion that the surrounding part moves into an inner space of the other groove of the other opposing member. The move-in motion ends when the shuttle members 11 and 12 come to the liquid discharging position as shown in FIGS. 1(*b*) and 1(*c*) where the tube 10 is compressed to be deformed in maximum. In the following, "compressed to be deformed" is called "squeezed" and "squeezing motion of the tube or called "tube squeezing" or simply "squeezing". The deformation due to squeezing the tube is called squeezing deformation.

The shuttle motion of the shuttle members 11 and 12 is realized by at least one of the shuttle members 11 and 12, for example, the shuttle member 12 reciprocally moving in parallel with the opposing surface of each opposing shuttle member 11 or 12. The move-in motion of the shuttle member 12 is generated in synchronous to the shuttle motion by the reciprocal drive mechanism. The details of the reciprocal drive mechanism will be discussed later.

The shuttle pumps in the prior art have opposing shuttle plates that slide in parallel to each other. Such slide motion and the driving mechanism thereof cause the decreasing and time-varying degrade of precision of the pump discharging rate. On the other hand, the first embodiment the present invention has the shuttle members 11 and 12 which correspond to the shuttle plates in the prior art generates move-in motion.

The pump operation by shuttle members 11 and 12 are explained. In the following discussion, it is assumed that the shuttle member 11 is fixed and the shuttle member 12 has up and down reciprocal motion that includes the shuttle motion and the move-in motion.

The tube 10 in FIG. 1(*a*) is held by the grooves 13 and 14 formed in the shuttle members 11 and 12, respectively. When the shuttle member 12 locates at the central position of the shuttle member 11, in other words, when the shuttle member 12 locates at the liquid holding position, the tube 10 is held in the grooves 13 and 14 and is not deformed. On the other hand, when the shuttle member 12 moves to the upper ward liquid discharging position, the groove 13 of the shuttle member 11 moves in the lower peripheral part of the groove 14 of the shuttle member 12. When the shuttle member 12 achieves the top dead center, the relation of the relative position of the shuttle members 11 and 12 becomes as shown in FIG. 1(*b*) and then the tube 10 is deformed by the shuttle members 11 and 12. By this deformation, the liquid filled in the tube 10 is discharged to downstream.

When the shuttle member comes back to the central position of the shuttle member 11, in other words, when the shuttle member 12 locates at the liquid holding position as shown in FIG. 1(*a*), the shape of the tube 10 decompress and the liquid is introduced from the upper stream to be filled in the tube. The shuttle member 12 further moves downward and the upper peripheral part of the groove 14 to the shuttle member 12 moves in the groove 13 of the shuttle member 11. When the shuttle member achieves the bottom dead center, the relation of the relative position of the shuttle member becomes as shown in FIG. 1(*c*) and then the tube 10 is deformed by the shuttle members 11 and 12. By this deformation, the liquid filled in the tube 10 is discharged to downstream.

(Shuttle Motion without Move-In)

The shuttle mechanism in the first embodiment as shown in FIGS. 1(*a*) to 1(*c*) has an advantage that the shuttle members 11 and 12 relatively move-in into the grooves 14 and 13 formed in the opposing shuttle members 12 and 11, respectively. As an explanation of the effect of this advantage, the problems for the case that the shuttle has the motion without such move-in is discussed with reference to FIGS. 2(*a*), 2(*b*) and 2(*c*) to FIGS. 5(*a*), 5(*b*) and 5(*c*).

Figure 41:
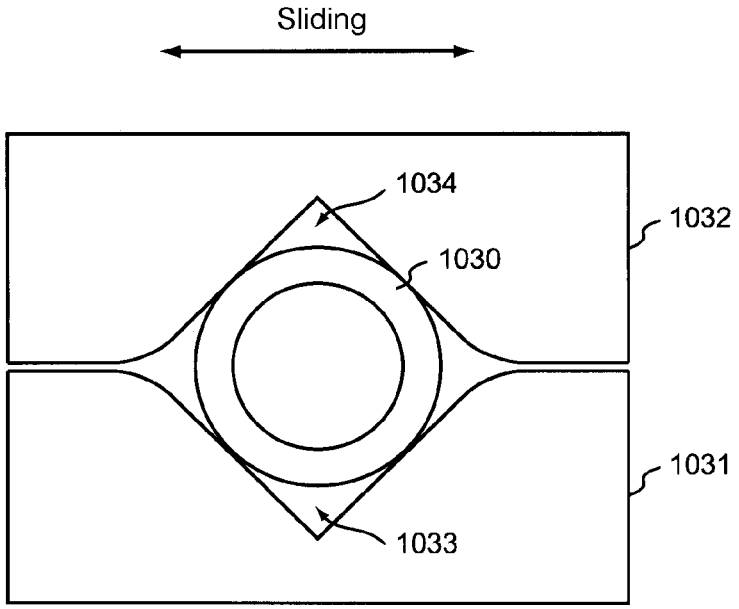
FIG. 41(*a*) is a schematic illustrating a cross-sectional view of another example of a prior art of shuttle mechanisms wherein the shuttle members can slide against each other with a gap.
Figure 41:
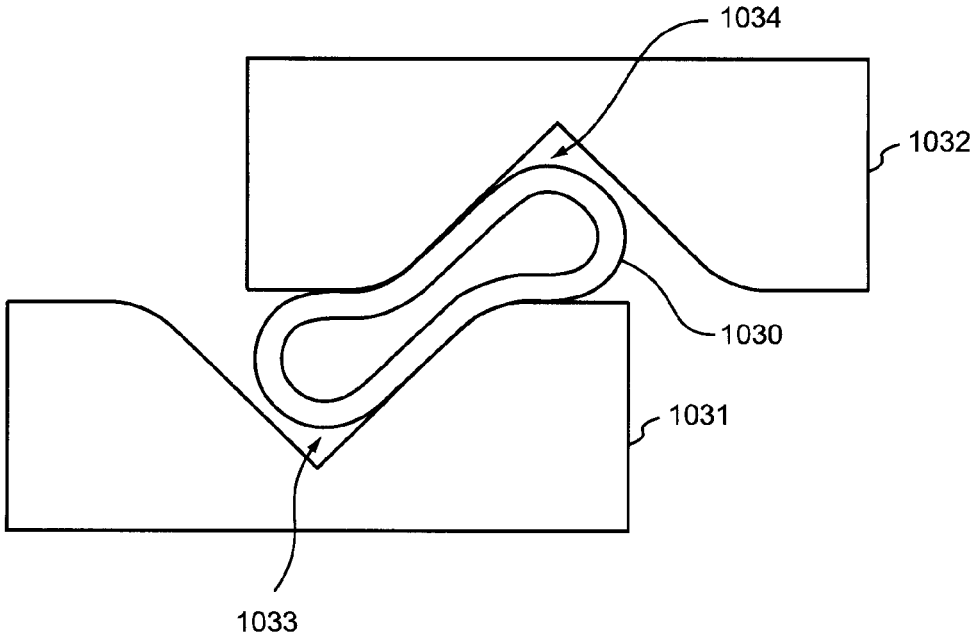

The shuttle mechanism wherein the shuttle member 11 and 12 has no move-in motion corresponds to the conventional shuttle mechanism as shown in FIGS. 41(*a*) and 41(*b*). The accuracy of the flow rate of the liquid flow is determined by the physical shape of the shuttle mechanism as discussed before. However, such determination implies that the accuracy depends on the tolerance of the shuttle mechanical assembly or the time-varying change of the shuttle mechanism. The problems due to tolerance or the time-varying change is quantitatively discussed below.

Figure 2:
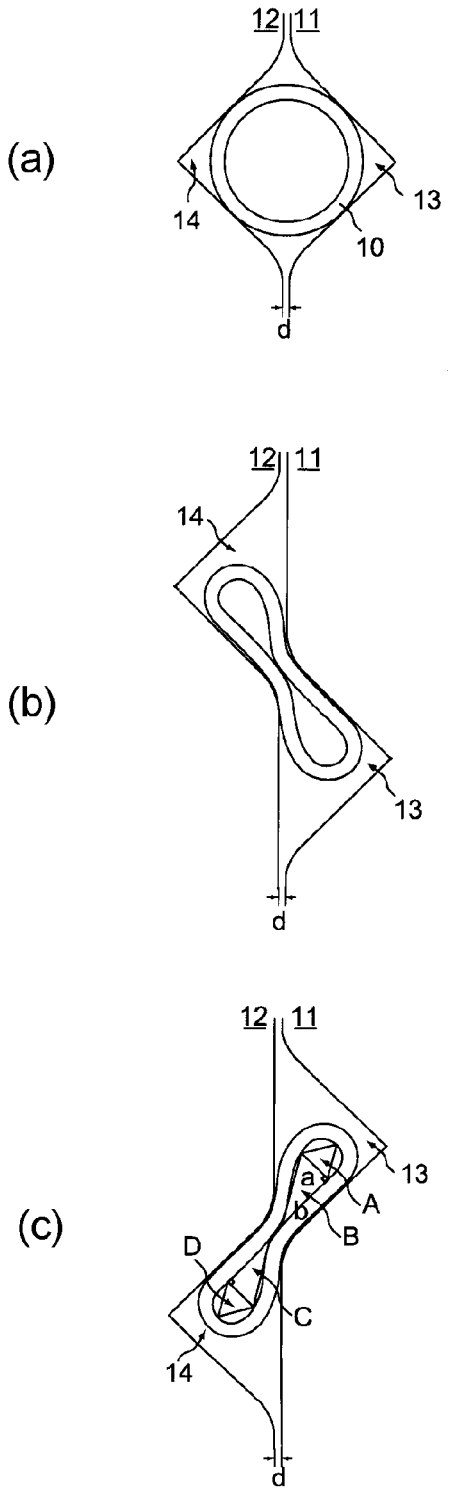
FIG. 2(*a*) is a schematic showing a motion of the shuttle members of conventional pumps wherein the shuttle members locate at the liquid holding position.

FIGS. 2(*a*) to 2(*c*) are schematics that show the motion of the shuttle members 11 and 12 that have no move-in motions, wherein the shuttle members 11 and 12 have a typical gap "d" between shuttle members 11 and 12. In this arrangement, "typical" means that the reasonable gap is selected so that the shuttle 11 and 12 do not mechanically contact. The relative motion of the shuttle member 11 and 12 is carried out up to the tube 10 to be deformed to shrink as the inside wall of the tube 10 does contact itself so that the tube 10 chokes. FIG. 2(*a*) shows the status that the shuttle members 11 and 12 locate at the liquid holding position and the tube 10 decompresses from the deformation. FIGS. 2(*b*) and 2(*c*) show the two cases of the deformation to shrinkage.

We take a typical example of the physical dimensions of the tube 10 as 3.6 mm outer diameter, 2.6 mm inner diameter. The cross sectional area of the tube 10 is 5.31 $mm^2$. The cross sectional area for the deformation to shrinkage is approximately divided into triangles A to D as shown in FIG. 2(*c*). The triangles A and D represent the bent sides of the tube 10 when the tube 10 pressed to be deformed to shrink. The center or the bent sides is the corner of triangles A and D and the direct distance of gap of the bent side is the base thereof. The triangles B and C are those that represent approximately the cross sectional areas of the tube 10 that is deformed to shrinkage and are right-triangles having two bases a and b.

The length of the base a is given by the tube wall thickness 0.5 mm (=(the external diameter−the inner diameter)/2) multiplied with k1, which is a coefficient determined by the elasticity of the elastic material of the tube 10 when the tube 10 is deformed. The height of the triangles A and D is given by the tube wall thickness 0.5 mm multiplied with k2, which is a coefficient determined by the elasticity of the elastic material of the tube 10 when the tube 10 is deformed. The length of the base b is the tube 10 radius 1.8 mm multiple with circular constant and flat length k3 of the deformation. Therefore the areas of the triangles A to D are, $$A=D=(k1\times 0.5\text{ mm})\times(k2\times 0.5\text{ mm})\times ½,$$

$$B=C=(k3\times 3.14\times 1.8\text{ mm})\times(k1\times 0.5\text{ mm})\times ½,$$

where, A to D denote the areas of the triangles A to D. The coefficients are determined by the hardness and the tube wall thickness of the tube 10 and are typically k1=1.5, k2=1.0, k3=0.3. Therefore the total areas is given by, $$A+B+C+D=1.65\text{ mm}^2.$$

This corresponds is 31% of the cross area of the tube 10 without any deformation. In other words, the liquid traveling volume is given by 5.31 $mm^2$−1.65 $mm^2$=3.66 $mm^2$ multiplied with the liquid traveling distance per second.

Figure 3:
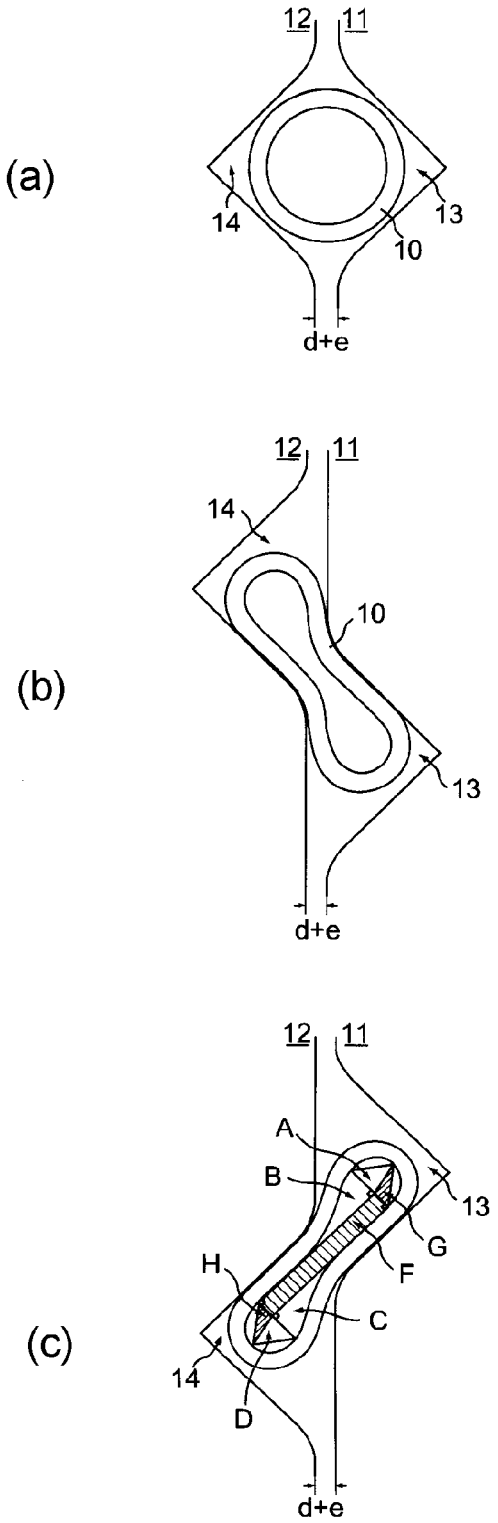
FIG. 3(*a*) is a schematic showing another motion of the shuttle members of a conventional pump wherein the shuttle members have no move-in motion wherein the shuttle members locate at the liquid holding position.

FIGS. 3(*a*) to 3(*c*) show an example of another motion of shuttle members 11 and 12 in the shuttle motion for prior art, which has no move-in motion. In this example, the gap between the shuttle members 11 and 12 increases by e from the typical value d. The shuttle members 11 and 12 as shown in FIG. 3(*a*) locate at the liquid holding position and the tube 10 decompresses from the deformation to shrinkage. FIGS. 3(*b*) and 3(*c*) show two cases where the tube 10 is deformed to shrinkage.

The deformed area of the cross section of the tube 10 increases by the areas of the rectangle F and those of the triangles G and H from the above summation of A, B, C and D as shown in FIG. 3(*c*). The rectangle F is given by the gap of the tube wall of the tube 10 due to insufficient deformation and specifically called "closing gap". Assuming the bottom angels of the grooves 13 and 14 of the shuttle members 11 and 12, the each area is given by, $$F=\frac{e}{1.41}\times 2b,$$

$$G=H=e/1.41\times(k2\times 0.5\text{ mm})\times 1/2,$$

where, F, G, H are the areas of the rectangle F and the triangles G and H, respectively and b and e represent the distance of base b and the increment of gap between the shuttle members 11 and 12 and the typical value of the coefficient is given by k2=2.0. As the conclusion, $$F+G+H=2.41e+0.355e=2.77e,$$

is obtained.

We consider the cases as e=0.1 mm and e=0.2 mm to evaluate the effect of the gap between the shuttle members 11 and 12. For these cases, the cross sectional areas of the tube 10 which is deformed to shrinkage are 1.65 $mm^2$+0.28 $mm^2$ and 1.65 $mm^2$+0.55 $mm^2$. Therefore the cross sectional areas related to the liquid traveling volume are 3.38 $mm^2$ and 3.11 $mm^2$. These figures are 7.6% and 15% less than the typical gap of the shuttle members 11 and 12. This implies that when an assembly tolerance is made 0.1 mm, the pump discharging volume decreases 7.6%. Such change is generated by tolerance in assembling process and the time-varying degradation of the shuttle mechanical assembly. In other words, the shuttle pump that has no move-in motion, the pump discharging volume largely changes due to the time-varying degradation of the gap between the shuttle members.

One of important applications of shuttle pumps is an infusion pump for medical use. For such an infusion pump, the repeatability of dose has to be less than 5%. Therefore, the conventional shuttle pumps which potentially change discharging volume due to the tolerance and time-varying degradation of shuttle mechanical assembly. In practical control of discharging volume, the relation of discharging volume per certain time duration against the shuttle motion speed of the shuttle mechanism is measured for each pump product and a calibration of dose against the shuttle motion speed is determined for each product from such relation before shipping. Therefore, time consuming process for such calibration is required in the manufacturing process and a problem such that the productivity of shuttle pumps for medical application is poor further remains.

Figure 4:
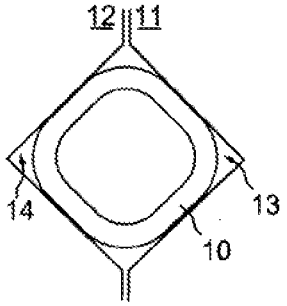
FIG. 4(*a*) is a schematic further showing another motion of the shuttle members of a conventional pump wherein the shuttle members have no move-in motion wherein the shuttle members are at the liquid holing position.
Figure 4:
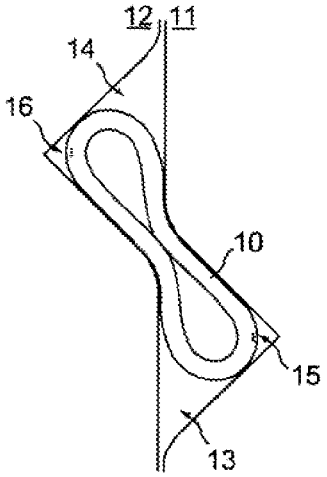
Figure 4:
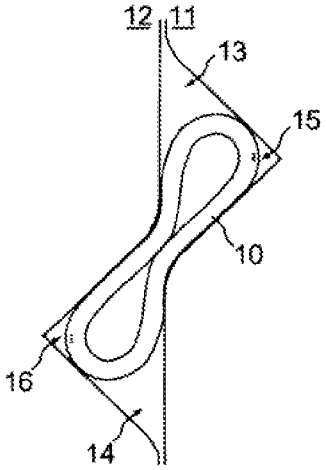

FIGS. 4(*a*) to 4(*c*) are schematics showing another motion of the shuttle members 11 and 12 of a conventional shuttle pump that has no move-in motion. For this shuttle mechanism, the grooves 13 and 14 are chosen to be smaller in relation to the diameter of the tube 10 comparing to those shown in FIGS. 2(*a*) to 2(*c*) and FIGS. 3(*a*) to 3(*c*). FIG. 4(*a*) shows the shuttle members 11 and 12 are at the liquid holing position and the tube 10 is depressed from the deformation. FIGS. 4(*b*) and 4(*c*) shows the shuttle members 11 and 12 are at the liquid discharging position and the tube 10 is compressed to deformation to shrink in two ends of the parallel motion of the shuttle members 11 and 12.

For this configuration of the shuttle mechanism, that comprises the shuttle members 11 and 12, the shuttle mechanism always over-compresses the tube 10. For the shuttle motion of the shuttle members 11 and 12, larger force is required than that required for a simple deformation to shrink as shown in FIGS. 2(*a*) to 2(*c*) and FIGS. 3(*a*) to 3(*c*) and the pump needs a large drive force. Therefore, the load against the pump motor (not shown in FIG. 4(*a*), 4(*b*) or 4(*c*)) is large and large power consumption is required.

The folding portions 15 and 16 are folded lines created by the shuttle motion of the shuttle members 11 and 12. These folding portions 15 and 16 do not largely change the positions of the inner and outer surfaces of the tube 10 in two ends of the parallel motion of the shuttle members 11 and 12. Therefore, the folding portions 15 and 16 easily fatigue and the elasticity in these folding portions 15 and 16 reduces with time. When the elasticity of the folding portions 15 and 16 reduces, the elastic force of the tube 10 to the decompression from the deformation to shrink reduces so that the discharging volume of the pump reduces with time. There is possibility that chaps are made along the folding portions 15 and 16. Once such chaps are made, external gems enter into the tube 10 and the liquid in the tube 10 is contaminated.

As discussed above, once the grooves 13 and 14 are chosen to be smaller in relation to the diameter of the tube 10, it possible to suppress the time variation of the discharging volume however there are problems that large pump power is required and the chaps are easily made along the tube 10.

Effects of the First Embodiment of the Present Invention

The shuttle mechanism of the shuttle pump regarding the first embodiment of present invention, as shown in FIGS. 1(*a*) to 1(*c*), has a move-in motion such that the shuttle members 11 and 12 vertically move to the opposing surface of the shuttle members 12 and 11 in a relation that the shuttle members 11 and 12 relatively moves into an inner space of the grooves 13 and 14. For this new mode of motion, the shuttle members 11 and 12 have no more such conventional shuttle motion that the shuttle members 11 and 12 shuttles in parallel with an opposing surface of the shuttle members 12 and 11, respectively. According to the move-in motion of the present invention, the shuttle members 11 and 12 shuttle in parallel with an opposing surface of the other opposing shuttle members 12 and 11 and have move-in motions such that the shuttle members 11 and 12 vertically move to the opposing surfaces of the other shuttle members 12 and 11 in a mutual relation that surrounding part of the groove thereof moves into the tube 10 and the occlusion gap (the rectangle F shown in FIG. 3(*c*)) in the tube 10 is not made. In the move-in motion, the shuttle members 11 and 12 relatively move into the other shuttle members 12 and 11, the occlusion gap is hardly made due to the principle of operation of the shuttle mechanism. Therefore, in the move-in motion of the shuttle members 11 and 12 in to the opposing shuttle member 12 and 11, the shuttle members 11 and 12 can press the tube 10 to deforming over compression which does not create an occlusion gap in the tube 10. Therefore, in comparison to the conventional shuttle pumps that have no move-in motion, it is possible to suppress the fluctuation and time-varying degradation of the discharging volume for the infusion pumps to which the present invention is applied.

The contact length f of the inside wall of the tube 10 of the present invention is longer than that of the conventional shuttle pump (for example, 0.1b to 0.2b for the case of the tube 10 shown in FIG. 2(*c*)). Therefore, when the shuttle members 11 and 12 are at the liquid discharging position where the tube 10 is mostly deformed, the remaining area of the cross section of the tube 10 is smaller than that of the tube 10 deformed by the conventional pump that has no move-in motion. This means the discharging volume due to tube deformation by move-in motion to shrinkage is larger than that by simple deformation by the shuttle motion of the conventional shuttle pumps. Since the remaining area of the cross section of the tube 10 is small, the remaining volume of the tube is small and has less variation. Therefore, the variation of discharging speed with time can be smaller than that of the conventional shuttle pumps. The fracturing incidence of tube 10 can hardly happens in the long-term pumping.

In the present embodiment, the tube deformation is made at folding portions 15 and 16 which are in the opposing portions around the annular ring of the cross section of the tube 10 and folding portions 17 and 18 which are 90 degree shifted ones from the folding portions 15 and 16 (see FIGS. 1(*b*) and 2(*c*)). Therefore, the tube deformation of the tube 10 are distributed over the whole annular ring of the tube 10 and the elasticity of the tube 10 is hardly lost so that the material fatigue of the tube 10 is less than the conventional shuttle motion that the shuttle members 11 and 12 shuttles in parallel with an opposing surface of the shuttle members 12 and 11, respectively as shown in FIGS. 2(*a*) to 2(*c*). Due to this feature, the time-dependent change in liquid transportation caused by filling and discharging the liquid becomes less than conventional shuttle motion, therefore the time-dependent change of the discharging speed of liquid becomes less and the fracturing incidence of tube 10 can hardly happen in the long-term pumping.

For the present embodiment, the tube 10 is over-compressed only when the shuttle members 11 and 12 are at the liquid discharging position, that is, when the shuttle members 11 and 12 move in maximum variance from the liquid holding position as shown in FIGS. 1(*b*) and 1(*c*). Therefore the pump driving power is less than that for the mechanism that the tube 10 is always over compressed by the shuttle members 11 and 12 as shown in FIGS. 4(*a*) to 4(*c*).

Second Embodiment of the Present Invention

Figure 5:
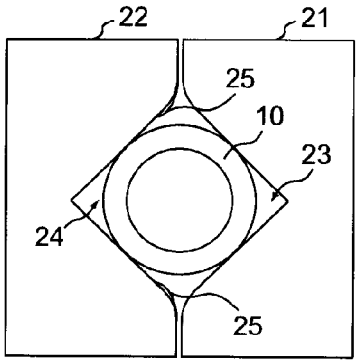
FIG. 5(*a*) is a schematic illustrating the pumping apparatus of the second embodiment of the present invention wherein the shuttle members are at the liquid holding position.
Figure 5:
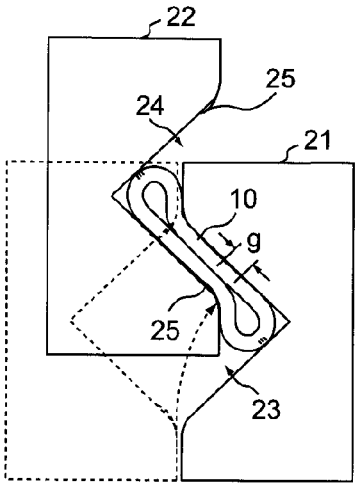
Figure 5:
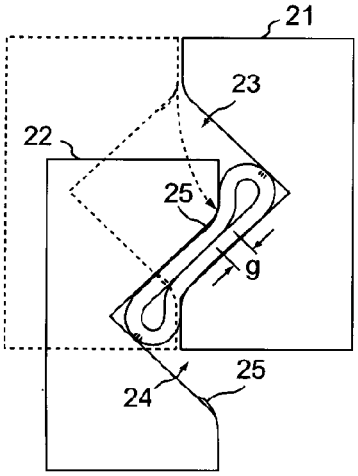

FIGS. 5(*a*) to 5(*c*) shows the second embodiment of the present invention. The shuttle mechanism and the motion thereof are only shown for the purpose of the simplicity.

This pumping apparatus is a shuttle pump and the tube 10 is used as a tube made of an elastic material. The pumping apparatus has two shuttle members 21 and 22 as two opposing members that are set along a longitudinal direction of the tube 10. A groove is formed on each of the opposing surfaces of the shuttle members 21 and 22, so that the grooves meet to form a space that holds the tube 10 in a cross section thereof.

At least one of the shuttle members 21 and 22 shuttles in parallel with an opposing surface of the other shuttle members 22 and 21, respectively and repeats a reciprocal motion between the liquid holding position as shown in FIG. 5(*a*) and the liquid discharging position as shown FIGS. 5(*b*) and 5(*c*). There are two liquid discharging positions, as shown in FIGS. 5(*b*) and 5(*c*), with a central position that is the liquid holding position in the reciprocal motion of the shuttle members 21 and 22. When the shuttle members 21 and 22 are at the liquid holding position as shown in FIG. 5(*a*), the grooves 23 and 24 meet to form a space that holds the tube 10 in the cross section thereof so that the tube 10 keeps the liquid introduced into the inner channel thereof. When the shuttle members 21 and 22 are at the liquid discharging position as shown in FIGS. 5(*b*) and 5(*c*), the shuttle members 21 and 22 scoot into the grooves 23 and 24, from the opposing position and deform the cross sectional shape of the tube 10 so that the liquid introduced into the tube 10 is discharged from the tube 10. The shuttle members 21 and 22 can also move in the direction vertical to the opposing surface of the shuttle members 21 and 22. When the grooves 23 and 24 move as the shuttle members 21 and 22 move from the opposing position, the surrounding part of one of the grooves 23 and 24 moves into an inner space of the groove of the other shuttle member.

The grooves 23 and 24 have substantively same triangle shape in the cross section and are triangular grooves. When the grooves 23 and 24 meet to oppose, then they form a substantively square channel in the longitudinal direction of the tube 10. One of the grooves 23 and 24, that is the groove 24 of the shuttle member 22 for this example have bumps 25 formed at both ends of the surface the groove 24. The bumps 25 deform the cross sectional area of the tube 10 to be shrunk of the inner cross section.

The first embodiment of the present invention as shown in FIGS. 1(*a*) to 1(*c*), the contact length f which is a length due to the force transferred from the compression to the outside of the tube 10 corresponds to the surface of the groove 13 or 14. The over compression is transferred to the length f. For this first embodiment, the length f is rather long because the surface of the groove 13 or 14 is flat. Therefore, there is a limitation to reduce the power loss due to over compression. The second embodiment of the present invention, as shown in FIGS. 5(*a*) to 5(*c*), wherein the shuttle member 22 has a bump 25 at the ends of the surface of the groove 24. The over compression to the tube 10 is made by the bump 25 at the liquid discharging position and the contact length g, that is made by the transfer of over compression made by the bump 25, is shorter than that of the first embodiment. Therefore, it is possible to effectively reduce pump driving power for the second embodiment since the over compression length is shorter. When the gap between the shuttle members 21 and 22 becomes larger than the initial gap due to the deterioration with age, the contact length g becomes smaller than the initial length but the remaining area of the cross section of the tube 10 which determines the remaining spatial capacity therein does not substantially reduce. Therefore, the discharging volume from the pump regarding the second invention can have less time-dependent change than the first embodiment as well as the conventional shuttle pumps.

The Third Embodiment

Figure 6:
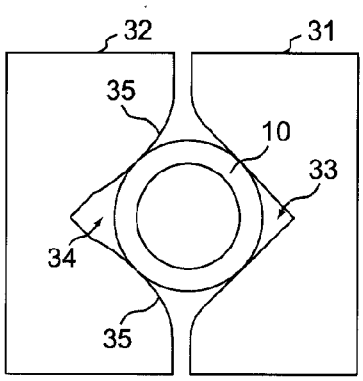
FIG. 6(*a*) is a schematic illustrating the pumping apparatus of the third embodiment of the present invention wherein the shuttle members are at the liquid holding position.
Figure 6:
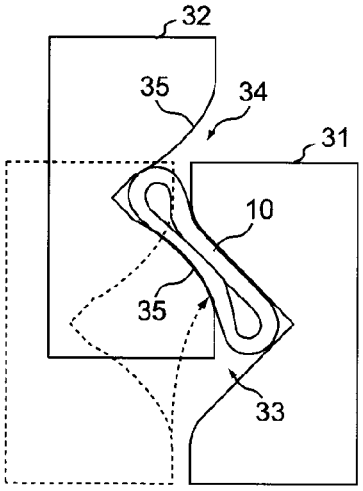
Figure 6:
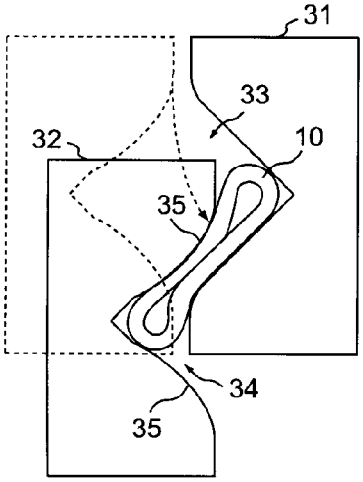

FIGS. 6(*a*) to 6(*c*) are schematics illustrating the pumping apparatus of the third embodiment of the present invention. Similar to the discussion with FIGS. 1(*a*) to 1(*c*) and FIGS. 5(*a*) to 5(*c*), only shuttle mechanism and the motion are explained.

The pumping apparatus shown in FIGS. 6(*a*) to 6(*c*) are shuttle pumps that comprise shuttle members 31 and 32 as opposing members that are set along a longitudinal direction of the tube 10 made of an elastic material. The shuttle members 31 and 32 have grooves 33 and 34 formed therein so that the grooves 33 and 34 meet to form a space that holds the tube 10 in a cross section thereof.

The shuttle members 31 and 32 have reciprocal motion, of which motion is realized with a shuttle motion such that at least one of the shuttle members 31 and 32 shuttles in parallel with an opposing surface of the other one of the shuttle members 31 and 32 between a liquid holding position as shown in FIG. 6(*a*) and a liquid discharging position as shown in FIGS. 6(*b*) and 6(*c*). There are two liquid discharging positions, as shown in FIGS. 6(*b*) and 6(*c*), with a central position that is the liquid holding position in the reciprocal motion of the shuttle members 31 and 32. When the shuttle members 31 and 32 are at the liquid holding position as shown in FIG. 6(*a*), the grooves 33 and 34 meet to form a space that holds the tube 10 in the cross section thereof so that the tube 10 keeps the liquid introduced into the inner channel thereof. When the shuttle members 31 and 32 are at the liquid discharging position as shown in FIGS. 6(*b*) and 6(*c*), the grooves 33 and 34, the shuttle members 31 and 32 move from the opposing position and deform the cross sectional shape of the tube 10 so that the liquid introduced into the tube 10 is discharged from the tube 10. The shuttle members 31 and 32 can also move in the direction vertical to the opposing surface of the shuttle members 31 and 32. When the grooves 33 and 34 move as the shuttle members 31 and 32 move from the opposing position, the surrounding part of one of the grooves 33 and 34 moves into an inner space of the groove of the other shuttle member.

The grooves 33 and 34 have substantively same triangle shapes in the cross section and are triangular grooves formed in the shuttle member 31 and 32, respectively. When the grooves 33 and 34 meet to oppose, then they form a substantively square channel in the longitudinal direction of the tube 10. One of the grooves 33 and 34, that is the groove 34 of the shuttle member 32 for this example have bumps 35 over the two surfaces of the groove 34 so that the bumps 35 deforms the cross sectional area of the tube 10 to be shrunk for the inner cross section. The bumps 35 are located on the central portion of the surfaces of the groove 34 so that the most deformed portion of the tube 10 is at the central area of the tube 10. Due to this bump design, the deformation of the tube 10 is uniformly distributed around the outer surface of the tube 10 and therefore the mechanical fatigue of the tube 10 can be lessened so that the discharging volume from the pump regarding the third invention can have less time-dependent change than the conventional shuttle pumps. Therefore, the discharging volume from the pump regarding the third invention can have less time-dependent change than as the conventional shuttle pumps. The fracturing incidence of tube 10 can hardly happens in the long-term pumping.

The Fourth Embodiment

Figure 7:
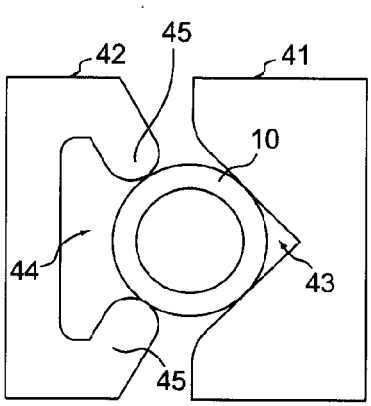
FIG. 7(*a*) is a schematic illustrating the pumping apparatus of the fourth embodiment of the present invention wherein the shuttle members are at the liquid holding position.
Figure 7:
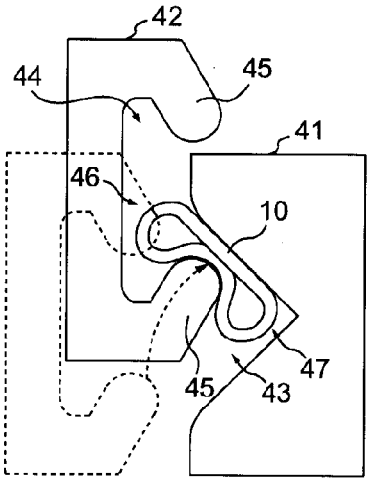
Figure 7:
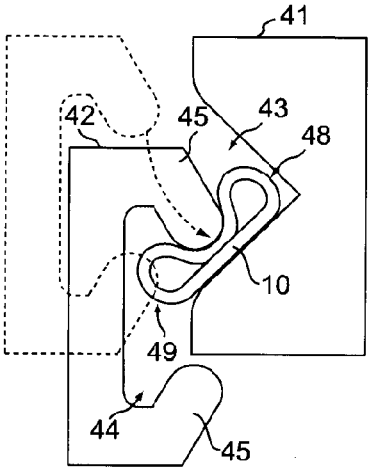

FIGS. 7(*a*) to 7(*c*) are schematics illustrating the pumping apparatus of the forth embodiment of the present invention. Similar to the discussion with FIGS. 1(*a*) to 1(*c*), FIGS. 5(*a*) to 5(*c*) and FIGS. 6(*a*) to 6(*c*), the shuttle mechanism and the motion are only explained.

The pumping apparatus shown in FIGS. 7(*a*) to 7(*c*) is a shuttle pump that comprises shuttle members 41 and 42 as opposing members that are set along a longitudinal direction of the tube 10 made of an elastic material. The shuttle members 41 and 42 have grooves 33 and 34 formed therein so that the grooves 43 and 44 meet to form a space that holds the tube 10 in a cross section thereof.

The shuttle members 41 and 42 have reciprocal motion, of which motion is realized with a shuttle motion such that at least one of the shuttle members 41 and 42 shuttles in parallel with an opposing surface of the other one of the shuttle members 41 and 42 between a liquid holding position as shown in FIG. 6(*a*) and a liquid discharging position as shown in FIGS. 7(*b*) and 7(*c*). There are two liquid discharging positions, as shown in FIGS. 6(*b*) and 6(*c*), with a central position that is the liquid holding position in the reciprocal motion of the shuttle members 41 and 42. When the shuttle members 41 and 42 are at the liquid holding position as shown in FIG. 7(*a*), the grooves 43 and 44 meet to form a space that holds the tube 10 in the cross section thereof so that the tube 10 keeps the liquid introduced into the inner channel thereof. When the shuttle members 41 and 42 are at the liquid discharging position as shown in FIGS. 7(*b*) and 7(*c*), the grooves 43 and 44, the shuttle members 41 and 42 move from the opposing position and deform the cross sectional shape of the tube 10 so that the liquid introduced into the tube 10 is discharged from the tube 10. The shuttle member 41 and 42 can also move in the direction vertical to the opposing surface of the shuttle member 41 and 42. When the grooves 43 and 44 move as the shuttle members 41 and 42 move from the opposing position, the surrounding part of one of the grooves 43 and 44 moves into (or move-in) an inner space of the groove of the other shuttle member. We call such "move into" or "move-in" motion "scoot" presented as "shuttle members scoot down to the groove" or simply "a shuttle member scoots in the other shuttle member", hereinafter.

One of the grooves 43 and 44, for example the groove 43 formed in the shuttle member 41 as shown in FIGS. 7(*a*) to 7(*c*) are schematics, has a triangle shape in the cross section and the other shuttle member 42 has two bumps 45 that are projections and deform the tube 10 to be shrunk for the inner cross section and the groove 44 that isolates these two bumps 45.

The deformation of the tube 10 by the shuttle member 42 scooting down to the groove 43 of the shuttle member 41 is strongly made at the folding portions 46 and 47 (as shown in FIG. 7(*b*)) and folding portions 48 and 49 (as shown in FIG. 7(*c*)). However the curvature radii are rather large since the bumps 45 have projection shapes. Therefore the fatigue of the tube 10 due to the deformation is less than that of the conventional shuttle pumps. As the results, the fracturing incidence of tube 10 can hardly happen in the long-term pumping.

(Reciprocal Drive of Shuttle Members)

In the above discussion, the shuttle mechanism (that is, a tube deformation mechanism) and the motion thereof were discussed to explain the major features of the present invention. In the following discussion, the mechanical elements, that is, at least one of two opposing members such as the shuttle members 11 and 12, 21 and 22, 31 and 32, or 41 and 42 shuttle in parallel with an opposing surface of the other opposing member so that reciprocal motion is realized with a shuttle motion such that at least one of the two opposing members and has a move-in motion such that the at least one of the two opposing members vertically moves to the opposing surfaces of the other opposing member in a mutual relation that surrounding part of the groove thereof moves into an inner space of the groove of the other opposing member.

(The First Embodiment of the Reciprocal Derive Mechanism)

Figure 8:
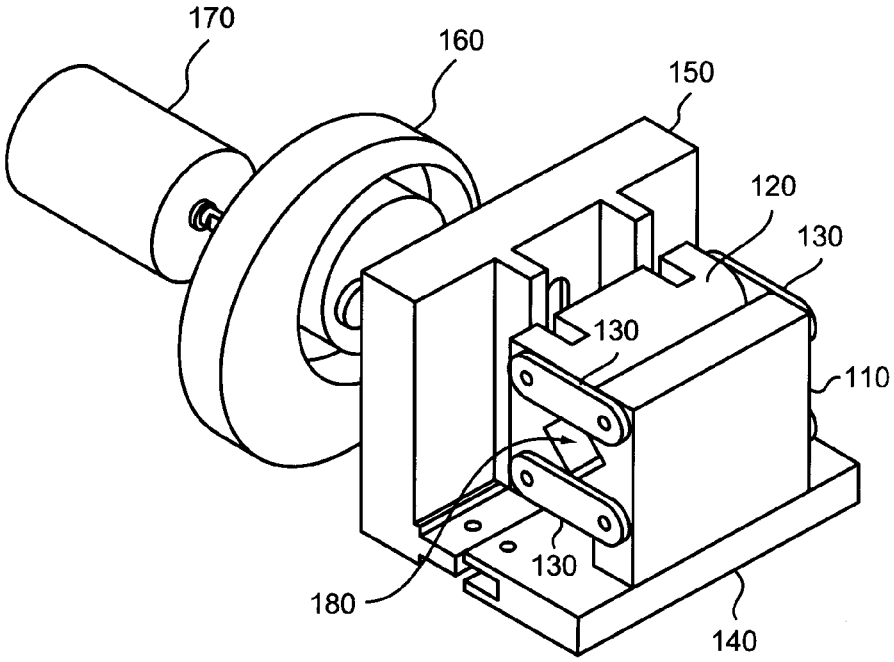
FIG. 8 is a schematic illustrating a perspective exploded view of the first embodiment of the reciprocal drive mechanism.
Figure 13:
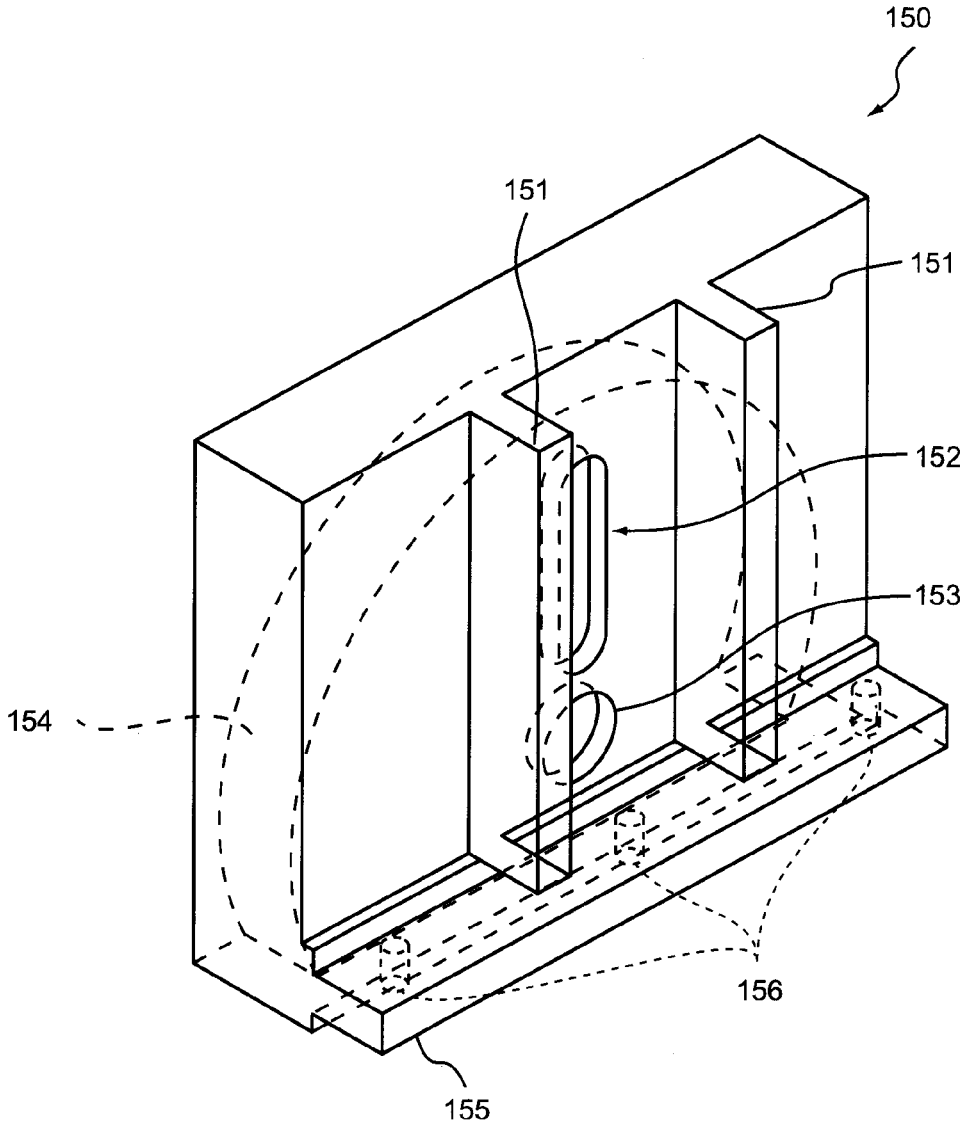
FIG. 13 is a schematic illustrating details of the mechanical structure of a guide member of the first embodiment of the reciprocal drive mechanism.
Figure 14:
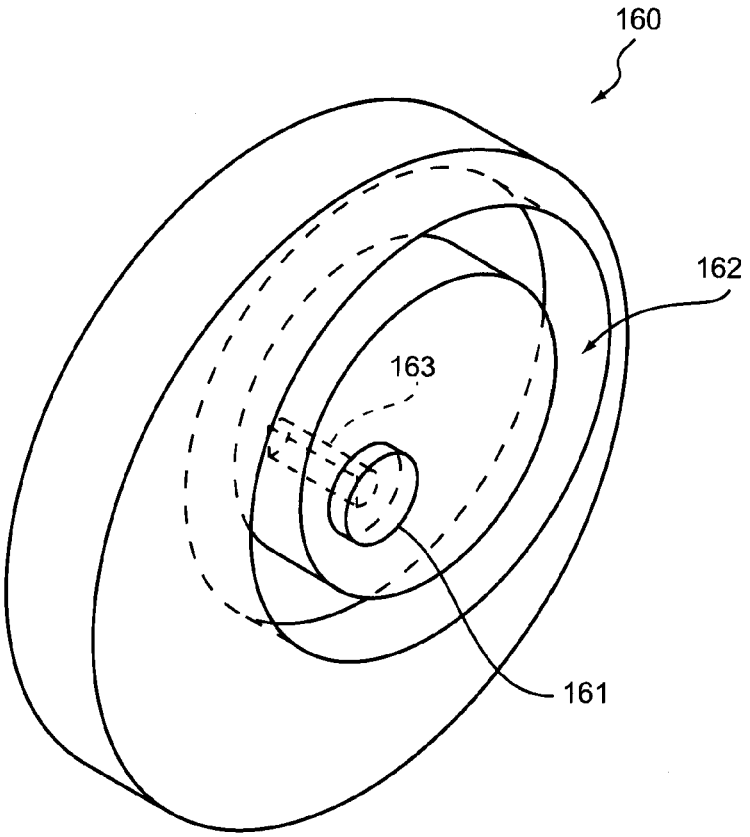
FIG. 14 is a schematic illustrating details of the mechanical structure of a rotary cam.

FIG. 8 is a schematic illustrating a perspective exploded view of the first embodiment of the reciprocal drive mechanism. A shuttle mechanism that is driven by the reciprocal drive mechanism is also shown in FIG. 8. The shuttle members 110 and 120 are used for the two opposing members of the shuttle mechanism. The reciprocal drive mechanism has four shuttle arms 130 that link the shuttle members 110 and 120 to each other via four joints in the linkage. The shuttle member 110 is fixed to the shuttle base 140. The shuttle member 120 is movable to the shuttle member 110. The reciprocal drive mechanism further has a transmission rod 123 (see FIG. 11 and FIG. 12) that is attached onto a reverse side of one of the shuttle member 120 facing to the shuttle member 110, a guide member 150 that has an opening 152 (see FIG. 13) in the range of the reciprocal motion of the shuttle members 110 and 120 and a rotary cam 160 being held in the guide member 150 and driven by a motor 170, that has a guiding cam trench 162 eccentrically made to rotational axis thereof (FIG. 14).

The shuttle member 110 is firmly fixed to the shuttle base 140. The shuttle member 120 can reciprocally move with shuttle motion in a vertical direction guided by the guide member 150. In order to drive the shuttle member 120, the rotary cam 160 and the motor 170 are used. The tube (which is not explicitly shown in the figures for the purpose of simplicity, hereinafter) that shall be deformed by the shuttle members 110 and 120 is set in the tube deforming groove 180 formed by the shuttle members 110 and 120 that oppose each other.

Each of four shuttle arms 130 is linked to the two shuttle members 110 and 120 at both ends in a linkage such that each of the four shuttle arms 130 is attached to the two shuttle members 110 and 120 to be rotatable in a surface vertical to longitudinal direction of the tube to be inserted in to a tube deforming groove 180 and that the shuttle members 110 and 120 can have the reciprocal motion between the liquid holding position and the liquid discharging position. In such reciprocal motion, one of the shuttle members 110 and 120 has a motion that the each opposing surface of the shuttle members 110 and 120 moves both in parallel with and in a direction vertical to the opposing surface thereof.

In this mechanical configuration, the motion of the shuttle members 110 and 120 is confined by the length of the shuttle arms 130 and traces in a circular arc against the other shuttle members 120 and 110, respectively. The periphery of the tube deforming groove 180 are formed in such a shape that the circular arc motion of the shuttle members 110 and 120 can be non-intrusive.

The four shuttle arms 130 are rotatably linked to the shuttle members 110 and 120. Each of the linkage is in parallel to the others. Therefore, the shuttle member 120 can scoot in the shuttle member 110 in parallel to each other and the shuttle members 110 and 120 deform the tube. The opposing surfaces of the shuttle members 110 and 120 are in parallel while shuttle members 110 and 120 deform the tube.

However, the upper ones of the four shuttle arms 130 and the lower ones of the four shuttle arms 130 that shown in FIG. 8 can be preferably non-parallel. In this case, the shuttle member 120 non-parallely scoot into the shuttle member 110 and the shuttle members 110 and 120 deform the tube 10. On the other hand, when the shuttle members 31 and 32 as shown in FIGS. 6(*a*) to 6(*c*) (or the shuttle members 41 and 42 as shown in FIGS. 7(*a*) to 7(*c*)) are used instead of the shuttle members 110 and 120, it is possible to for the shuttle member 32 (or shuttle member 42) scoot into the shuttle member 31 (or shuttle member 41) vertically to the contacting plane between the tube and the bump 35 (or the bump 45).

The case that four shuttle arms 130 are used in the above embodiment has been disclosed, however five or more shuttle arms can be used in order to realize the same reciprocal motion.

Figure 9:
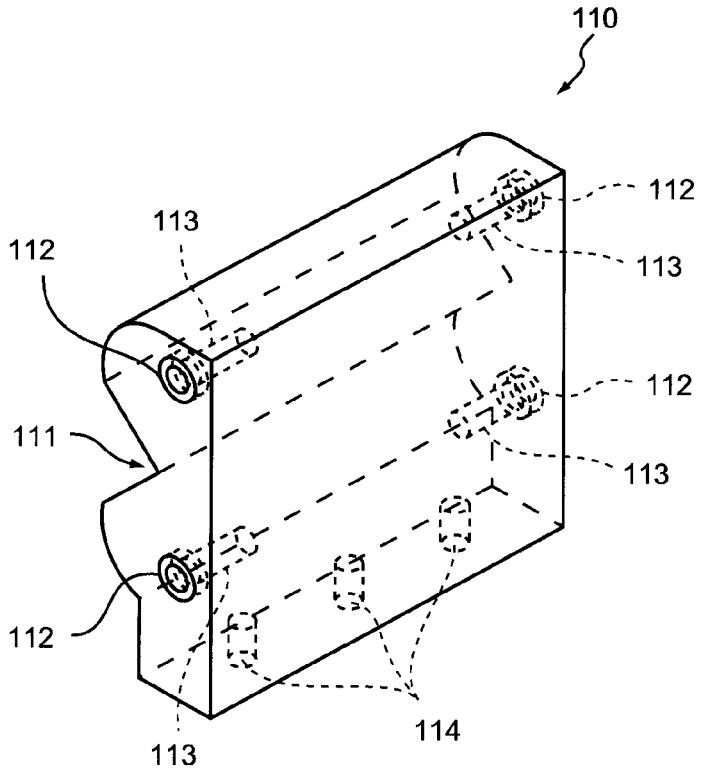
FIG. 9 is a schematic illustrating details of the mechanical structure of a shuttle member of the first embodiment of the reciprocal motion.

FIG. 9 is a schematic illustrating details of the mechanical structure of a shuttle member 110 of the first embodiment of the reciprocal drive mechanism. In a perspective view. The shuttle member 110 has a groove 111, shaft bearings 112, shaft holes 113 and screw holes 114. The groove 111 forms a part of a tube deforming groove 180. The bearings 112 and the four shaft holes 113 are formed corresponding to four shuttle arms 130 that are fitted to freely rotate around the shaft bearings 112. The shuttle member 110 fixed to the shuttle base 140 with bolts that are screwed to the screw holes 114 through bolt through-holes 142.

Figure 10:
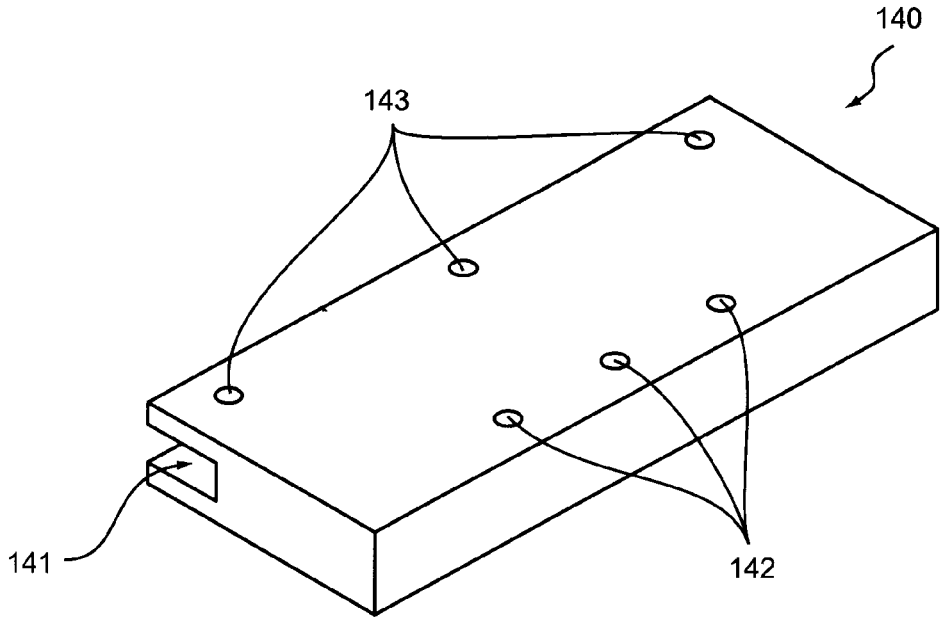
FIG. 10 is a schematic illustrating details of the mechanical structure of a shuttle base of the first embodiment of the reciprocal drive mechanism.

FIG. 10 is a schematic illustrating details of the mechanical structure of a shuttle base 140 of the first embodiment of the reciprocal drive mechanism in a perspective view. The shuttle base 140 fixes the shuttle member 110 thereto and is fixed to a guide member 150 in which the shuttle member 120 is guided with opposing to the shuttle member 110. The shuttle base 140 has a coupling groove 141 and bolt through-holes 142 and 143.

The coupling groove 141 is to fix the shuttle base 140 to the guide member 150 and the bolt through-hole 143 is made in penetrating the coupling groove 141. The shuttle base 140 is fixed to the guide member 150 with bolts that penetrate the bolt through-hole 143. The shuttle member 110 is fixed to the shuttle base 140 by bolt screwed from the back side of the shuttle base 140 penetrating through-hole 114.

Figure 11:
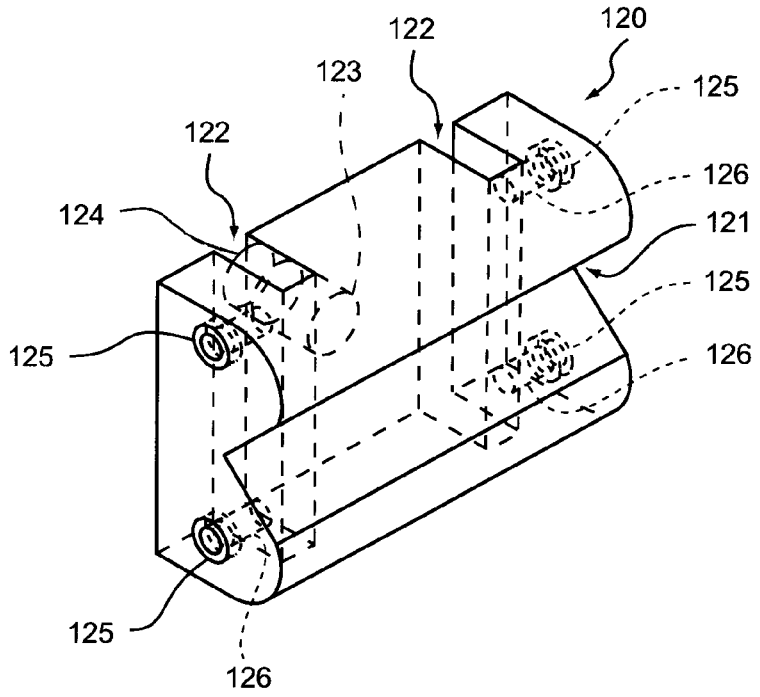
FIG. 11 is another schematic illustrating details of the mechanical structure of a shuttle member of the first embodiment of the reciprocal drive mechanism.
Figure 12:
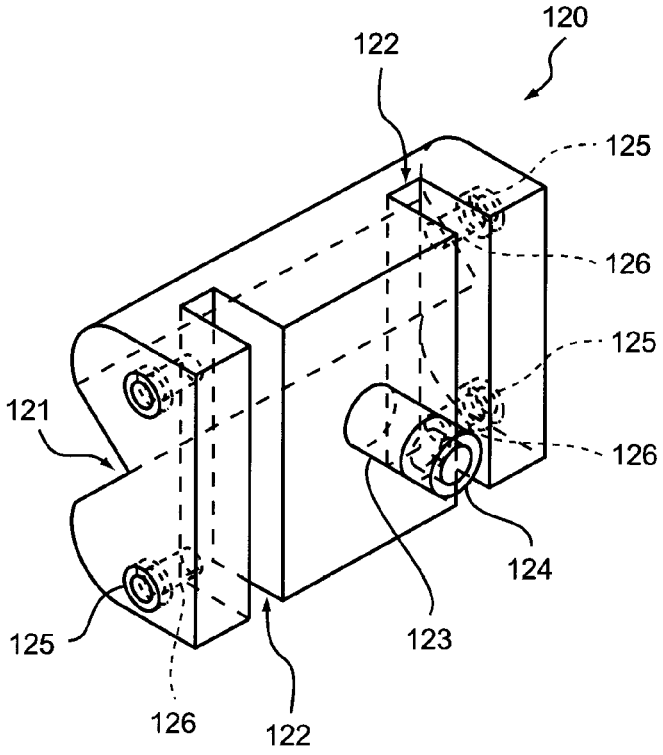
FIG. 12 is a schematic illustrating details of the mechanical structure of a shuttle member of the first embodiment of the reciprocal drive mechanism.

FIG. 11 and FIG. 12 are schematics illustrating details of the mechanical structure of a shuttle member of the first embodiment of the reciprocal drive mechanism, especially the shuttle member 120 in a perspective view. FIG. 11 is a schematic of the shuttle member 110 from the back side thereof and FIG. 12 is from the guide member 150. The shuttle member 120 has a groove 121, a guiding grooves 122, a transmission rod 123, a roller 124, bearings 125 and shaft holes 126.

The groove 121 comprises a part of a tube deforming groove 180. The guiding grooves 122 guides the shuttle member 120 along an guiding rails 151 (as shown in FIG. 13) and the shuttle member 120 can make upward and downward motion to squeeze the tube with little allowance. The transmission rod 123 has a tip placed in the inside of the guiding cam trench 162 (as shown in FIG. 14), through an opening 152 of the guide member 150, that works as a tracing groove of the rotary cam 160 and converts the rotational motion of the rotary cam 160 to the upward and downward reciprocal motion of the shuttle member 120. A roller 124 is attached to the end of the transmission rod 123 so that traces the guiding cam trench 162 of the rotary cam 160 with little friction. The roller 124 can be a ball bearing or another antifriction bearing. As same as the shuttle member 110, the shuttle member 120 has four pairs of the bearing 125 and the shaft hole 126 for four shuttle arms 130 which can freely rotates. However the shuttle member 120 has no screw holes to be fixed to the shuttle base 140.

The bearings 112 and 125 of the shuttle members 110 and 120 are to reduce the rotational friction of the shuttle arms 130 and to make smooth rotation against the shuttle members 110 and 120. For such bearings 112 and 125, ball bearings, roller bearings or oil metal bearings are preferably used. The allowance between the groove 111 of the shuttle member 110 and the groove 121 of the shuttle member 120 can be reduced in the shuttle motion by using bearing 112 and 125 so that the discharge volume of the liquid that is squeezed in the tube can be constant. Therefore the pumping volume of the pumps of the present invention can be consistent in time passing.

FIG. 13 is a schematic illustrating details of the mechanical structure of a guide member 150. The guide member 150 converts the revolving motion of the rotary cam 160 to upward and downward motion that is necessary for tube squeezing motion. The guide member 150 comprises the guiding rails 151, the opening 152, a cam shaft bearing 153, a cam hall 154, a base coupling tab 155 and bolt through-holes 156. A cam shaft 161 of the rotary cam 160 is inserted in the cam shaft bearing 153 (see FIG. 14).

The guiding rails 151 couples with the guiding grooves 122 made in the shuttle member 120 and regulates the motion thereof. The opening 152 regulates the motion of the transmission rod 123 of the shuttle member 120 (see FIG. 12) into upward and downward motion. The cam shaft 161 of the rotary cam 160 is inserted into the cam shaft bearing 153 (see FIG. 14). The rotary cam 160 is set in the cam hall 154.

The base coupling tab 155 and the bolt through-holes 156 combine the guide member 150 and shuttle base 140 by inserting the base coupling tab 155 of the guide member 150 into the coupling groove 141 of the shuttle base 140 (see FIG. 10) and inserting coupling bolts (not shown in FIG. 10) into the bolt through-holes 156.

FIG. 14 is a schematic illustrating details of the mechanical structure of the rotary cam 160. The rotary cam 160 comprises a cam shaft 161, the guiding cam trench 162 and the motor shaft bearing hole 163.

The cam shaft 161 is inserted into the cam shaft bearing 153 made in the guide member 150. The rotary cam 160 is rotatably set in the cam hall 154 of the guide member 150 (see FIG. 13). The transmission rod 123 (see FIG. 12) of the shuttle member 120 is set in the guiding cam trench 162 through the opening 152 (see FIG. 12) of the guide member 150.

The guiding cam trench 162 is eccentrically formed against the rotational center of the motor shaft bearing hole 163. The roller 124 of the shuttle member 120 is guided by the guiding cam trench in accordance to the rotation of the rotary cam 160, while the motion of the transmission rod 123 of the shuttle member 120 in which the roller 124 is attached is regulated by the opening 152 of the guide member 150. Due to this construction, the rotational motion of the rotary cam 160 is converted to the upward and downward reciprocal motion of the shuttle member 120. This upward and downward reciprocal motion is further regulated by the guiding rails 151, the guiding grooves 122 and the shuttle arms 130 and converted to tube squeezing motion generated by the shuttle member 120.

Figure 15:
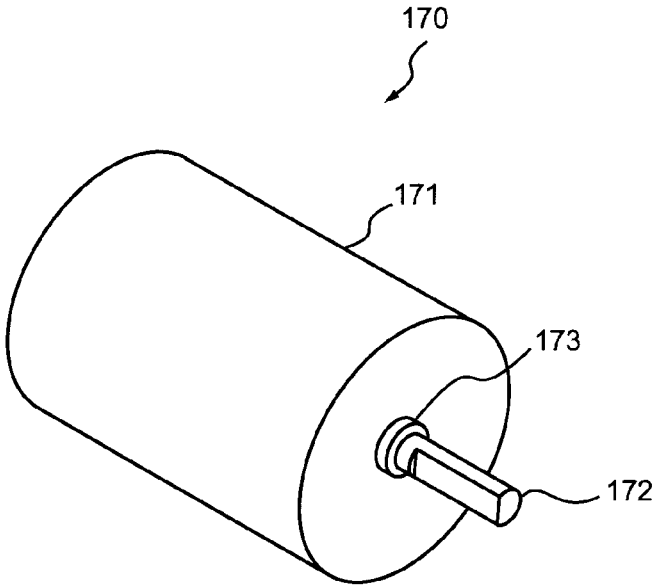
FIG. 15 is a schematic illustrating perspective view of a motor.

FIG. 15 is a schematic illustrating perspective view of the motor 170 that rotates rotary cam 160. The motor 170 is preferably a geared motor that has a rotation reduction gear since the rotary cam 160 needs slow rotation speed. The motor 170 has a main motor unit 171 and a motor shaft 172 that has D-cut shape in the cross section. The motor shaft 172 is supported by a motor bearing 173.

(The Second Embodiment of the Reciprocal Drive Mechanism)

Figure 16:
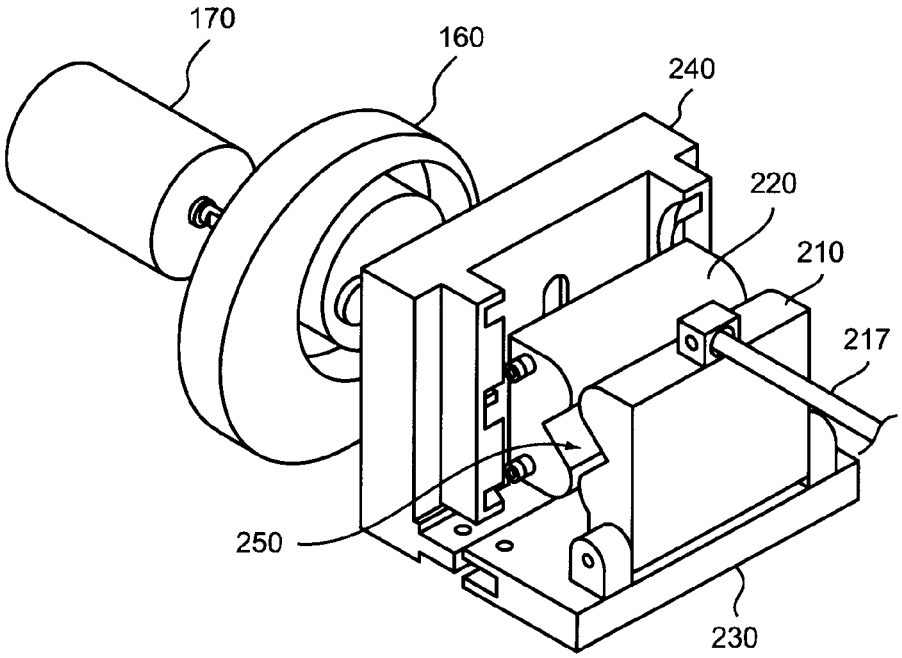
FIG. 16 is a schematic illustrating a perspective exploded view of the second embodiment of a reciprocal drive mechanism.

FIG. 16 is a schematic illustrating a perspective exploded view of the second embodiment of a reciprocal drive mechanism. FIG. 16 also shows a shuttle mechanism that is driven by a reciprocal drive mechanism. In this embodiment, two shuttle members 210 and 220 are used as two opposing members of a shuttle mechanism. The shuttle member 210 is firmly fixed to the shuttle base 230. The shuttle member 220 is a movable member to the shuttle member 210. The reciprocal drive mechanism has a guide member 240 that works to guide one (the shuttle member 220 for this embodiment) of the shuttle members 210 and 220 to the other (the shuttle member 210 for this embodiment) of the opposing members 210 and 220. The shuttle member 220 and the guide member 240 respectively have protrusions (that are, the guiding rods 224) and guiding grooves (that are, the shuttle motion guiding grooves 247) by which the shuttle member 220 can parallely move against the shuttle member 210 so that the shuttle member 220 have the reciprocal motion between the liquid holding position and the liquid discharging position. In conjunction with such reciprocal motion, the shuttle member 220 and the guide member 240 respectively have pairs of the guiding rods 224 and shuttle rollers 225 (see FIG. 19 and FIG. 20) and the shuttle motion guiding grooves 247 (see FIG. 21) which work as a means by which the shuttle member 220 moves in the direction vertical to the opposing plane of the shuttle member 220 against the shuttle member 210. These are the means that, being explained as the problems to be solved by this invention in paragraph [0036], are to provide a guidance in a manner that the guiding member has guiding grooves into which guiding rods attached to one of the two opposing members are put to trace thereof and that the two opposing members have the reciprocal motion between the liquid holding position and the liquid discharging position. The reciprocal drive mechanism further has a transmission rod 222 (see FIG. 20) on the back surface which is the reverse side of the opposing surface of the shuttle member 220 against the shuttle member 210, an opening 242 (see FIG. 21) that corresponds to the range of reciprocal motion of the shuttle member 210 and 220 and the rotary cam 160 that has a guiding cam trench eccentrically made to the rotational axis driven around by the motor 170.

The tube to be squeezed by the shuttle members 210 and 220 is inserted in the tube deforming groove 250 formed by the opposing surfaces of the shuttle members 210 and 220. The mechanical structure of a rotary cam 160 is equivalent to that shown in FIG. 14. The motor 170 and the motor components are equivalent to those shown in FIG. 15. Referring to FIG. 14 and FIG. 15, the present embodiment is explained in the following paragraphs.

The large differences of the second embodiment of the reciprocal drive mechanism shown in FIG. 16 from the first embodiment discussed with FIG. 8 to FIG. 15 are the mechanism that shuttle member 210 can be opened to the shuttle member 220 so that the tube can be inserted from the upper side to the tube deforming groove 250 formed between the shuttle members 210 and 220. In order to open the shuttle member 210, the guiding rods 224 and the shuttle motion guiding groove 247 are made instead of the shuttle arms 130 as the means that the shuttle member 210 shuttles in parallel with an opposing surface of the shuttle member 220 and has a move-in motion that is vertical to the longitudinal direction of the tube 10 and the direction of shuttle motion of the shuttle member 210.

Figure 17:
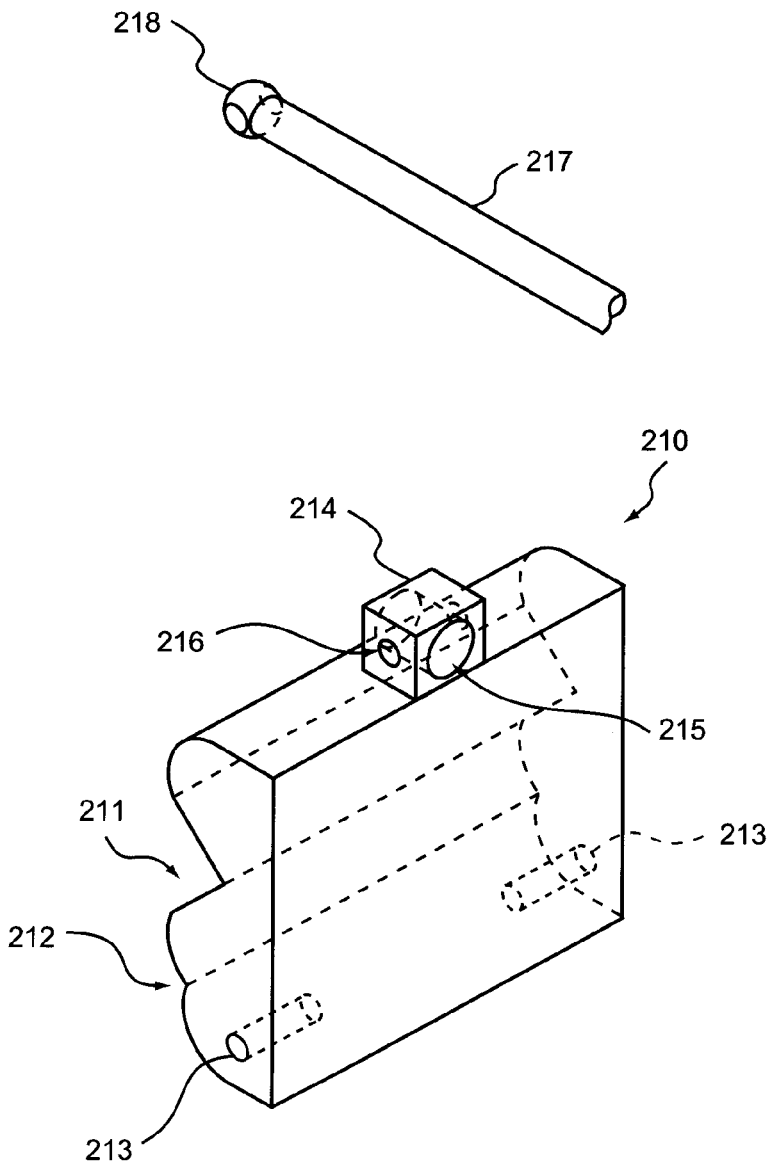
FIG. 17 is a schematic illustrating a perspective view of details of a shuttle member and a shuttle opening rod of the second embodiment of a reciprocal drive mechanism.

FIG. 17 is a schematic illustrating a perspective view of details of a shuttle member 220 and a shuttle opening rod. The shuttle member 210 has a groove 211, foot portions 212, mounting holes 213 and a coupling box 214.

Figure 18:
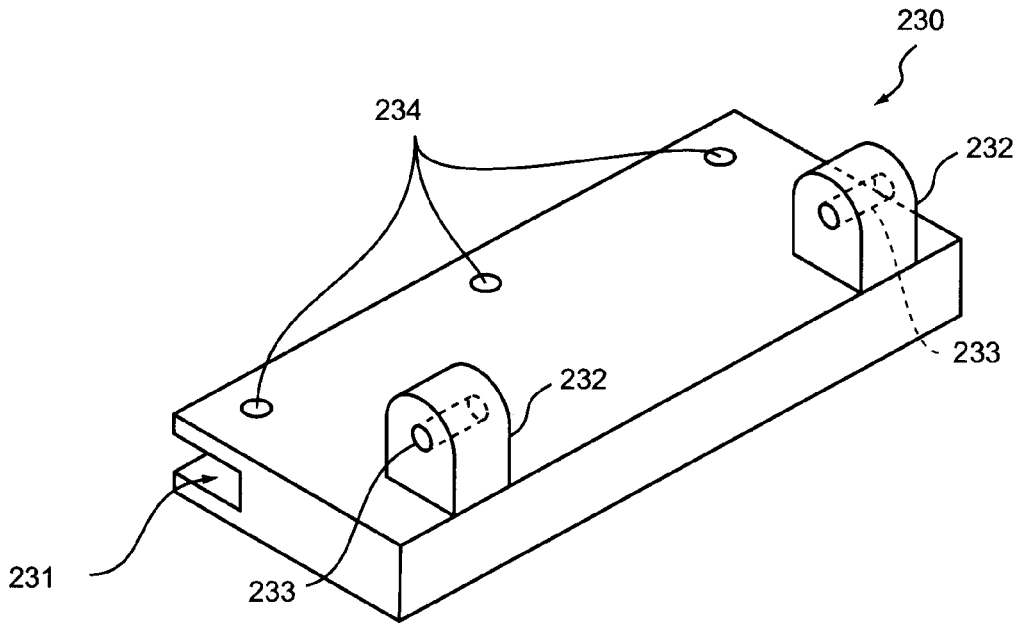
FIG. 18 is a schematic illustrating a perspective view of a shuttle base of the second embodiment of a reciprocal drive mechanism.
Figure 19:
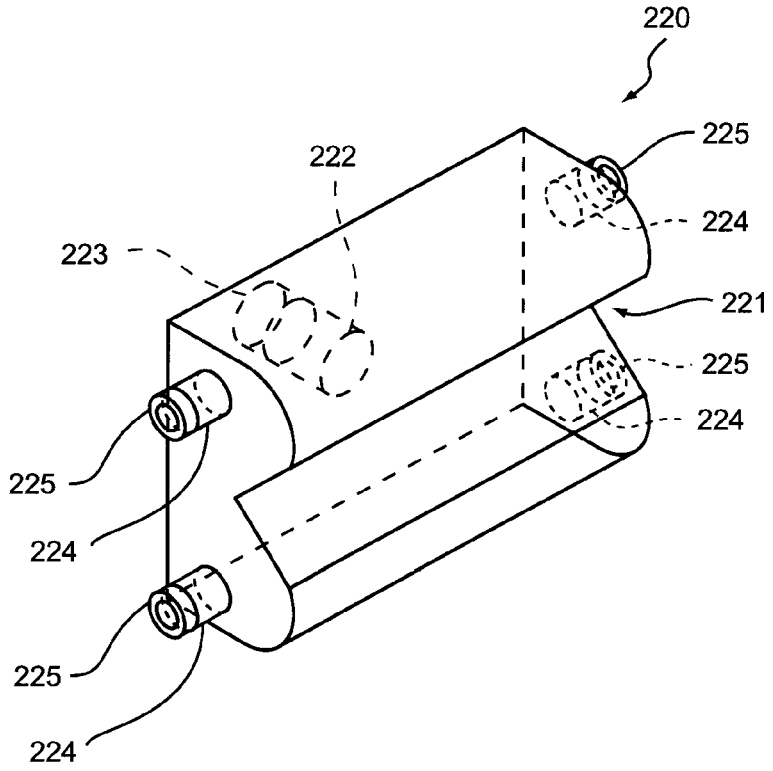
FIG. 19 is a schematic illustrating a perspective view of a shuttle member of the second embodiment of a reciprocal drive mechanism.

The groove 211 conforms a tube deforming groove 250 with a groove 221 of the shuttle member 220 (see FIG. 19). The foot portion 212 is rotatably mounted to shuttle member mounting stands 232 on the shuttle base 230 (see FIG. 18) with bolts (not shown in the figures) through the mounting holes 213 and mounting stand holes 233 (see FIG. 18). The coupling box 214 has rod joint hole 215 and a rod joint pin hole 216. A shuttle opening rod 217, of which tip has a ball tip 218, is fitted into the coupling box 214. The ball tip 218 is inserted into the rod joint hole 215 and jointed to the coupling box 214 with a joint pin to be set in the rod joint pin holes 216 so that the shuttle member 210 can rotate in some extent within the plane including the shuttle opening rod 217 and a smooth opening of the shuttle member 210 to insert/release the tube into/from the shuttle mechanism is allowed.

FIG. 18 is a schematic illustrating a perspective view of a shuttle base 230. The shuttle base 230 is combined with the guide member 240 as well as the shuttle member 210 is rotatably combined with the shuttle base 230 and holds the shuttle member 220 to oppose to the shuttle member 210. The shuttle base 230 has two mounting stand holes 233 in the shuttle member mounting stands 232 such that an axis that penetrates through the two mounting stand holes 233 is parallel to the surface of the shuttle base 230 and two mounting holes 213 are made in the shuttle member 210 so that the shuttle member 210 is rotatably combined therewith and opens or closes against the shuttle member 220 in a hinge motion. The shuttle base 230 has a coupling groove 231, a shuttle member mounting stand 232 and bolt through-holes 234 that penetrate across the coupling groove 231.

The coupling groove 231 is to join the shuttle base 230 with the guide member 240. The shuttle base 230 is coupled with the guide member 240 via the coupling groove 231 and fixed to the guide member 240 with the bolts (not shown in FIG. 18) screwed in the bolt through-holes 234. The shuttle member 210 is rotatably coupled with the shuttle member mounting stand 232 via the two the mounting holes 213 and mounting stand holes 233 with bolts (not shown in the FIG. 17 and FIG. 18).

Since the shuttle member 210 is coupled with the guide member 240, the shuttle members 210 and 220 can be opened to upper side in a hinge motion by pulling the shuttle member 210 with a shuttle opening rod 217 when the tube is set in the shuttle mechanism. In this state, the tube is mounted in the inserted in the tube deforming groove 250 formed with the groove 211 (see FIG. 19) in the shuttle member 210 and the groove 221 in the shuttle member 220. The tube setting process is completed after the shuttle member 210 is reset in a vertically standing position by pushing back the shuttle opening rod 217 in a hinge motion so that the shuttle member 210 and 220 are closed against upper side.

In the present embodiment, the shuttle member 210 can rotate with an axis at the foot portion 212. However the shuttle member 210 can preferably be made rotated around a pivotal piece that is attached thereto.

Figure 20:
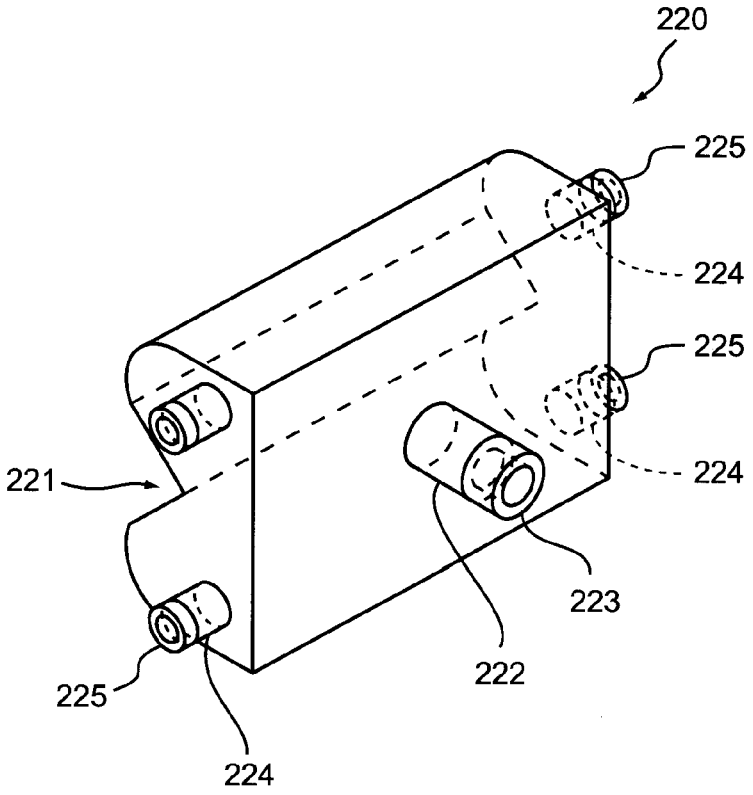
FIG. 20 is another schematic illustrating details of the mechanical structure of a shuttle member of the second embodiment of the reciprocal drive mechanism.

FIG. 19 and FIG. 20 are perspective illustrations that show the details construction of the shuttle member 220. FIG. 19 shows the view from the shuttle member 210 and FIG. 20 from the guide member 240. The shuttle member 220 has the groove 221, the transmission rod 222, the roller 223, the guiding rods 224 and the shuttle rollers 225.

The groove 221 composes the tube deforming groove 250 with the groove 211 formed in the shuttle member 210 opposing thereto (see FIG. 16). The transmission rod 222 is set in the guiding cam trench 162 that works as a tracing groove of the rotary cam 160 (as shown in FIG. 14) and converts the rotational motion of the rotary cam 160, through the opening 242 of the guide member 240, to the upward and downward reciprocal motion of the shuttle member 220. The shuttle member 220 can make upward and downward motion to squeeze the tube with little allowance. A roller 223 is attached to the end of the transmission rod 222 which, therefore, traces the guiding cam trench 162 of the rotary cam 160 with little friction (see FIG. 14). The roller 223 can be a ball bearing or another antifriction bearing.

The shuttle member 220 has two guiding rods 224 for each side. Each guiding rod 224 has the shuttle roller 225 at the tip. The guiding rods 224 and the shuttle rollers 225, in cooperation with the shuttle motion guiding groove 247 of the guide member 240, compose the protrusion and the guiding grooves that guide the protrusion and make the shuttle member 220 to have the reciprocal motion between the liquid holding position and the liquid discharging position as well as the shuttle member 220, that opposes to the shuttle member 210, to move in the direction vertical to the opposing surfaces of the shuttle member 210 to the shuttle member 220.

Figure 21:
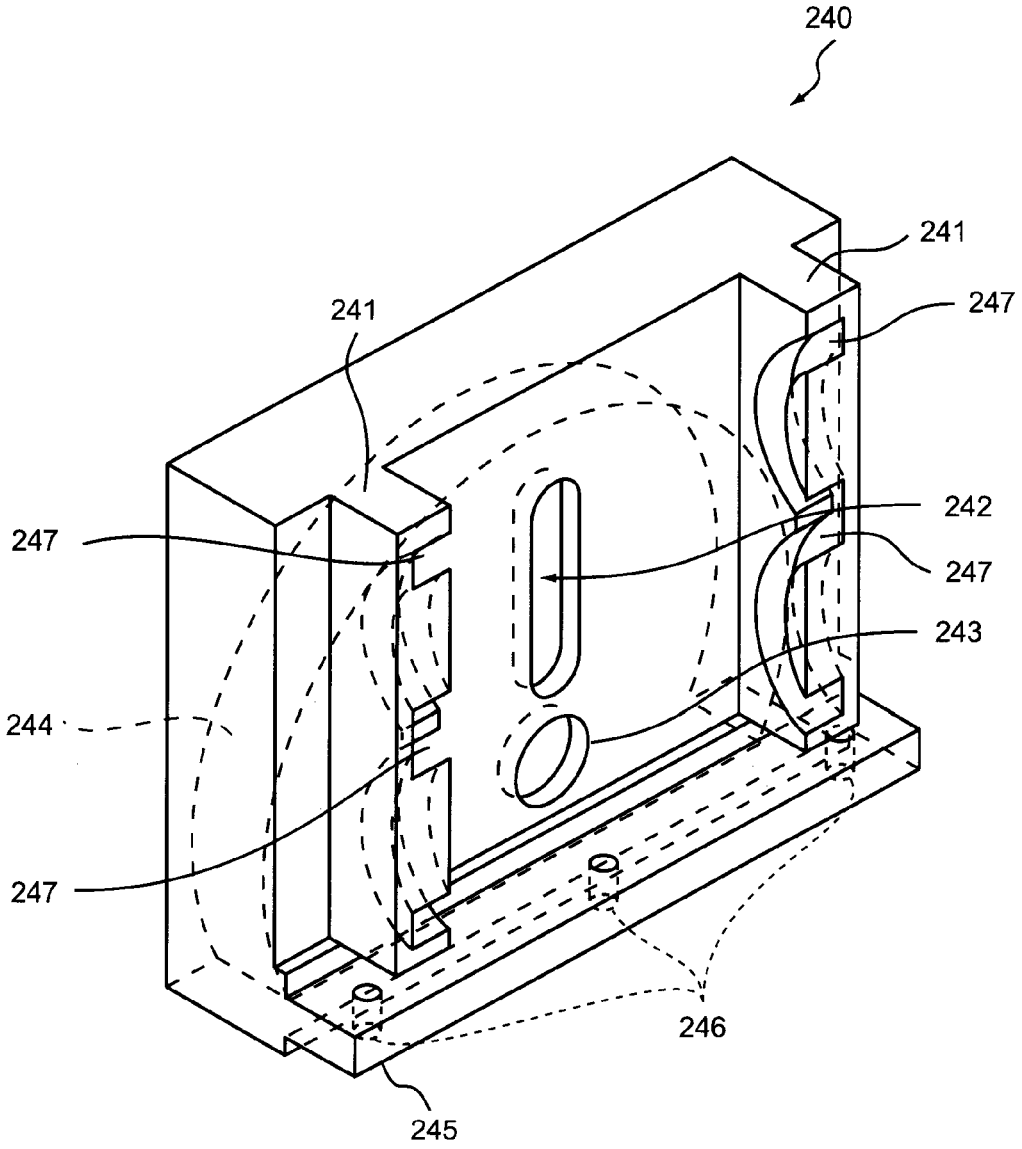
FIG. 21 is a schematic illustrating details of the mechanical structure of a shuttle member of the second embodiment of the reciprocal drive mechanism.

FIG. 21 is a schematic illustrating details of the mechanical structure of the guide member 240. The guide member 240 is a guiding component that guides the motion of one of the shuttle members 210 and 220 (that is, the shuttle member 220 for this embodiment) to the other (that is, the shuttle member 210 for this embodiment) and converts the rotational motion of the rotary cam 160 to the upward and downward reciprocal motion that is necessary for tube squeezing motion. The guide member 240 has two guiding walls 241, an opening 242, a cam shaft bearing 243, a cam hall 244 and a base coupling tab 245 which has bolt through-holes 246. Each of these two guiding walls 241 has two shuttle motion guiding grooves 247.

Each of two guiding walls 241 has two shuttle motion guiding grooves 247 to which shuttle rollers 225 of the shuttle member are engaged. The shuttle motion guiding groove 247 guides the shuttle roller 225 and the guiding rods 224 to which the shuttle rollers 225 are attached, reciprocally moves the shuttle member 220 relatively against the shuttle member 210 between the liquid holding position and the liquid discharging position and makes a move-in motion such that the shuttle member 220 mutually moves to the shuttle member 210 in a direction vertical to the opposing surface of shuttle member 220 against the shuttle member 210. The cam shaft bearing 243.

Two guiding walls 241 regulate the motion of the shuttle member 220 into the lateral direction (that is, the longitudinal direction of the tube). The shuttle motion guiding groove 247 controls the route of the motion of the shuttle member 220 such that tube squeezing motion is generated by the shuttle member 220 which can reciprocally move and scoot to the shuttle member 210.

The two shuttle motion guiding grooves 247, one formed in the upper position and the other lower position of one guiding wall 241, have the same shape. The separating distance of these two shuttle motion guiding grooves 247 is same as that of two shuttle rollers 225 formed in one side surface of the shuttle member 220. Due to such structural relation, the surfaces of the groove 211 of the shuttle member 210 and those of the groove 221 of the shuttle member 220 which are opposing each other can keep parallel during the tube squeezing motion.

By differentiating the separation distance between the two shuttle motion guiding grooves 247 from that between the two shuttle rollers 225, the shuttle member 220 can move against the shuttle member 210 in a non-parallel motion. For this structural relation of the separation distances, the shuttle member 220 non-parallely scoots to the shuttle member 210 and makes tube squeezing motion as shown in FIGS. 5(*a*) to 5(*c*), FIGS. 6(*a*) to 6(*c*) and FIGS. 7(*a*) to 7(*c*). In other words, it is possible for the bump (as shown the bumps 25, 35 and 45 in FIGS. 5(*a*) to 5(*c*), FIGS. 6(*a*) to 6(*c*) and FIGS. 7(*a*) to 7(*c*), respectively) to scoot in a right angle into the contact surface between the bump and the tube for such a shuttle mechanism that the grooves 211 and 221 of the shuttle members 210 and 220 have bumps, respectively.

Ball bearings or oil-metal bearing are preferably used for the shuttle rollers 225 that move with tracing the shuttle motion guiding grooves 247 in order to realize being smoothly guided therein. By using these bearing components, the movement of the shuttle member 220 can be smoothened and the backlash between the bearing components and the shuttle motion guiding grooves 247 can be suppressed during reciprocal shift motion guided in the shuttle motion guiding grooves 247 so that the discharge volume of the liquid that is squeezed in the tube can be constant. Therefore the pumping volume of the pumps of the present invention can be consistent in time passing.

The opening 242 formed in the guide member 240 regulates the motion of the transmission rod 222 of the shuttle member 220 of which tip is guided by the guiding cam trench 162 of the rotary cam 160 (see FIG. 14) to the upward and downward direction. The cam shaft 161 of the rotary cam 160 is inserted into the cam shaft bearing 243 (see FIG. 14). The rotary cam 160 is set in the cam hall 244.

The base coupling tab 245 and the bolt through-holes 246 combine the guide member 240 and shuttle base 230 by inserting the base coupling tab 245 of the guide member 240 into the coupling groove 231 of the shuttle base 230 (see FIG. 18) and inserting coupling bolts (not shown in FIG. 10) into the bolt through-holes 234.

The motions of the rotary cam 160 and the motor 170 are same as those of the first embodiment of the reciprocal drive mechanism. The rotational motion of the rotary cam 160 is converted to the upward and downward reciprocal motion of the shuttle member 220. The upward and downward reciprocal motion is further converted into the tube squeezing motion is generated by the shuttle member 220 by being regulated with the guide member 240, the shuttle motion guiding groove 247, guiding rods 224 and shuttle rollers 225.

(The Third Embodiment of the Reciprocal Drive Mechanism)

Figure 22:
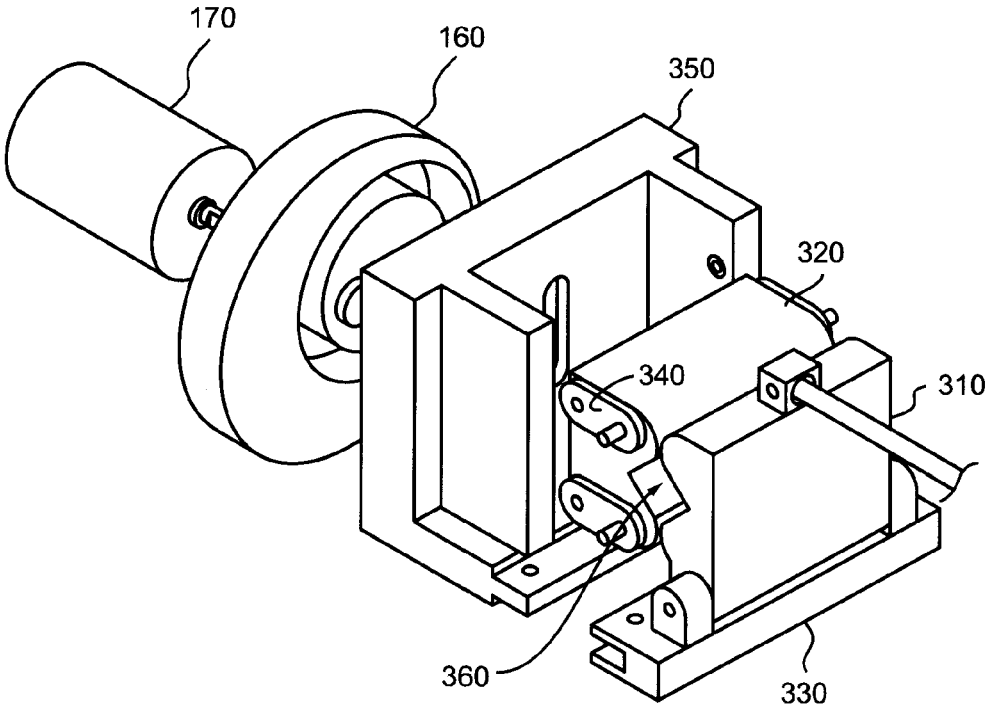
FIG. 22 is a schematic illustrating a perspective exploded view of the third embodiment of a reciprocal drive mechanism.

FIG. 22 is a schematic illustrating a perspective exploded view of the third embodiment of a reciprocal drive mechanism. FIG. 22 also shows a shuttle mechanism that is driven by a reciprocal drive mechanism. In this embodiment, two shuttle members 310 and 320 are used as two opposing members of a shuttle mechanism. The shuttle member 310 is firmly fixed to the shuttle base 330. The shuttle member 320 is a movable member to the shuttle member 310. The reciprocal drive mechanism has a guide member 350 to which one (which is the shuttle member 320 for the present embodiment) of the two opposing shuttle members 310 and 320 is linked with four shuttle inner arms 340. Each of the four shuttle inner arms 340 is set to the guide member 350 at one end and the shuttle member 320 at the other end and is rotatable in the plane perpendicular to the tube in dual direction (that is, a direction of upward and downward) and a direction of a move-in motion by which the shuttle inner arm 340 makes a motion against the shuttle member 320 such that the shuttle member 310 relatively moves in a direction right to the opposing surface of the shuttle member 320 against the shuttle member 310 as well as the shuttle member 320 has the reciprocal motion between the liquid holding position and the liquid discharging position. The reciprocal drive mechanism further has a transmission rod 322 (see FIG. 26) on the back surface which is the reverse side of the opposing surface of the shuttle member 320 against the shuttle member 310, an opening 352 (see FIG. 27) that corresponds to the range of reciprocal motion of the shuttle member 310 and 320 and a rotary cam 160 that has a guiding cam trench 162, that is, a guiding cam trench eccentrically made to the rotational axis driven around by the motor 170.

The tube to be squeezed by the shuttle members 310 and 320 is inserted in the tube deforming groove 360 formed by the opposing surfaces of the shuttle members 310 and 320. The mechanical structure of the rotary cam 160 is equivalent to that shown in FIG. 14. The motor 170 and the motor components are equivalent to those shown in FIG. 15. Referring to FIG. 14 and FIG. 15, the present embodiment is explained in the following paragraphs. Since the assembly construction of the shuttle members 310 and the shuttle base 330 are also equivalent to that of shuttle member 210 and shuttle base 230, the explanation of the assembly construction is left out.

The large differences of the third embodiment of the reciprocal drive mechanism shown in FIG. 22 from the first embodiment discussed with FIG. 8 to FIG. 15 are the mechanisms that have, instead of four shuttle arms 130, four shuttle inner arms 340 which are rotatably set to guide member 350 instead of the shuttle member 310.

Figure 23:
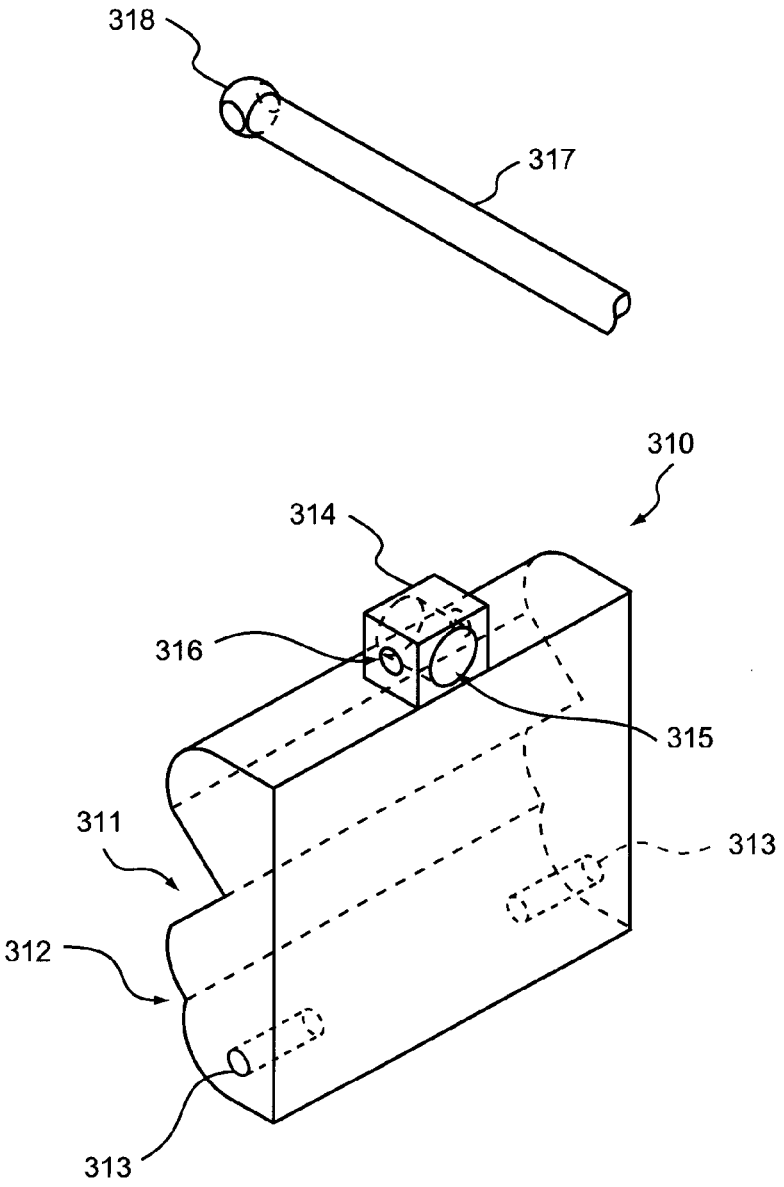
FIG. 23 is a schematic illustrating details of the mechanical structure of a shuttle member and a shuttle opening rod.

FIG. 23 is a schematic illustrating a perspective view of details of a shuttle member 310 and a shuttle opening rod 317. The shuttle member 310 has a groove 311, foot portions 312, mounting holes 313 and a coupling box 314.

Figure 24:
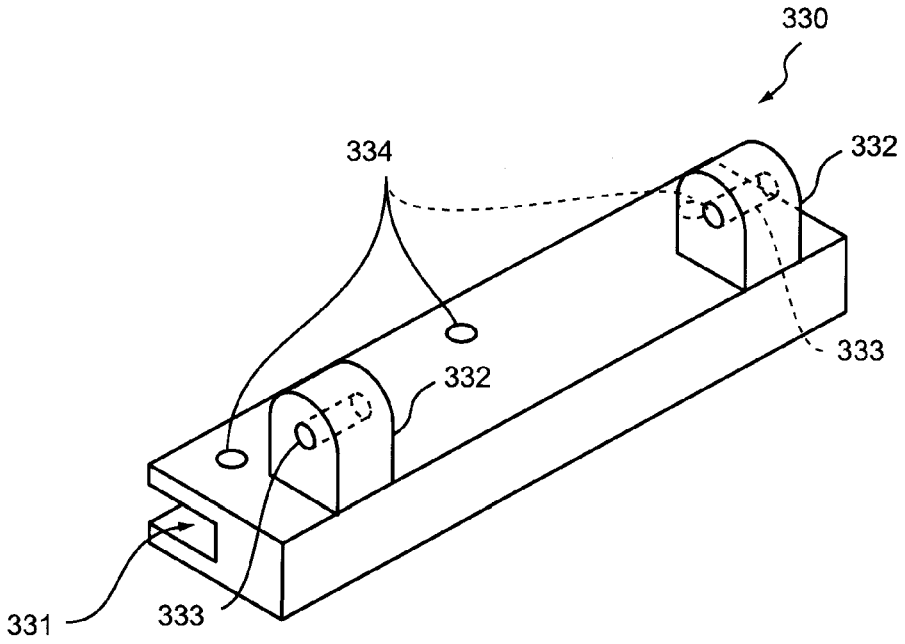
FIG. 24 is a schematic illustrating details of the mechanical structure of a shuttle base of the third embodiment of the reciprocal drive mechanism.
Figure 25:
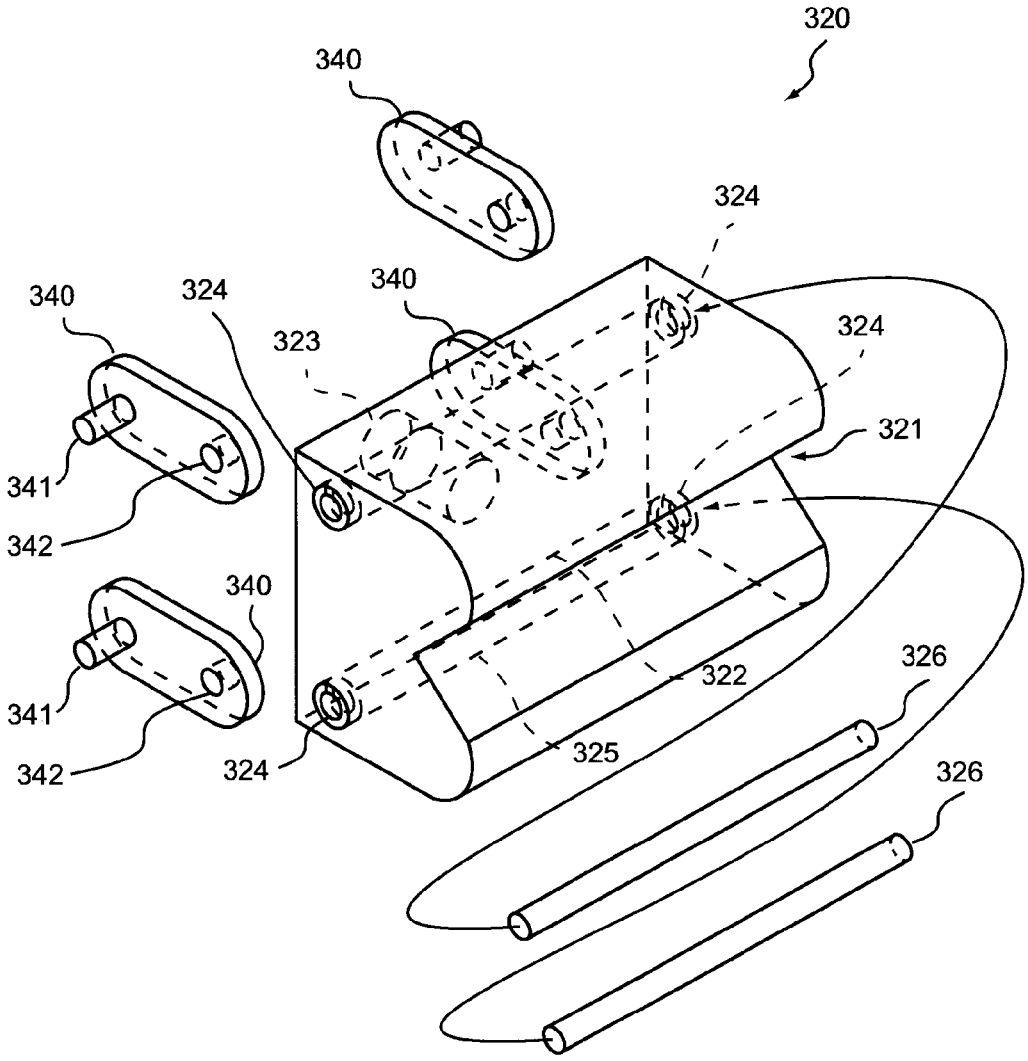
FIG. 25 is a schematic illustrating a perspective view of details of a shuttle member, a shuttle inner arm and arm shafts of the third embodiment of a reciprocal drive mechanism.

The groove 311 conforms a tube deforming groove 360 (see FIG. 22) with a groove 321 of the shuttle member 320 (see FIG. 25). The foot portion 312 is rotatably mounted to the shuttle member mounting stands 332 on the shuttle base 330 (see FIG. 24) with bolts (not shown in the figures) through mounting holes 313 and mounting stand holes 333 (see FIG. 24). A coupling box 314 has a rod joint hole 315 and a rod joint pin hole 316. A shuttle opening rod 317, of which tip has a ball tip 318, is fitted into the coupling box 314. The ball tip 318 is inserted into the rod joint hole 315 and jointed to the coupling box 314 with a joint pin to be set in rod joint hole 315 so that the shuttle member 310 can rotate in some extent within the plane including the shuttle opening rod 317 and a smooth opening of the shuttle member 310 to insert/release the tube into/from the shuttle mechanism is allowed.

FIG. 24 is a schematic illustrating a perspective view of a shuttle base 330. The shuttle base 330 is combined with the guide member 350 as well as the shuttle member 310 is rotatably combined with the shuttle base 330 and holds the shuttle member 320 to oppose to the shuttle member 310. The shuttle base 330 has two mounting stand holes 333 in the shuttle member mounting stands 332 such that an axis that penetrates through the two mounting stand holes 333 is parallel to the surface of the shuttle base 330 and two mounting holes 313 are made in the shuttle member 310 so that the shuttle member 310 is rotatably combined therewith. The shuttle base 330 has a coupling groove 331, a shuttle member mounting stage 332 and bolt through-holes 334 that penetrate across the coupling groove 331.

The coupling groove 331 is to join the shuttle base 330 with the guide member 350. The shuttle base 330 is coupled with the guide member 350 via the coupling groove 331 and fixed to the guide member 350 with the bolts screwed in the bolt through-holes 334. The shuttle member 310 is rotatably coupled with the shuttle member mounting stage 332 via the mounting holes 313 and mounting stand holes 333 with bolts (not shown in the FIG. 23 and FIG. 24).

Since the shuttle member 310 is coupled with the guide member 330, the shuttle members 310 and 320 can be opened to upper side in a hinge motion by pulling the shuttle member 310 with a shuttle opening rod 317 when the tube is set in the shuttle mechanism. In this state, the tube is set into the tube deforming groove 360 formed with the groove 311 (see FIG. 22) in the shuttle member 310 and the groove 321 in the shuttle member 320. The tube setting process is completed after the shuttle member 310 is reset in a vertically standing position by pushing back the shuttle opening rod 317 in a hinge motion so that the shuttle member 310 and 320 are closed against upper side.

In the present embodiment, the shuttle member 310 can rotate with an axis at the foot portion 312. However the shuttle member 310 can preferably be made rotated around a pivotal piece that is attached thereto.

Figure 26:
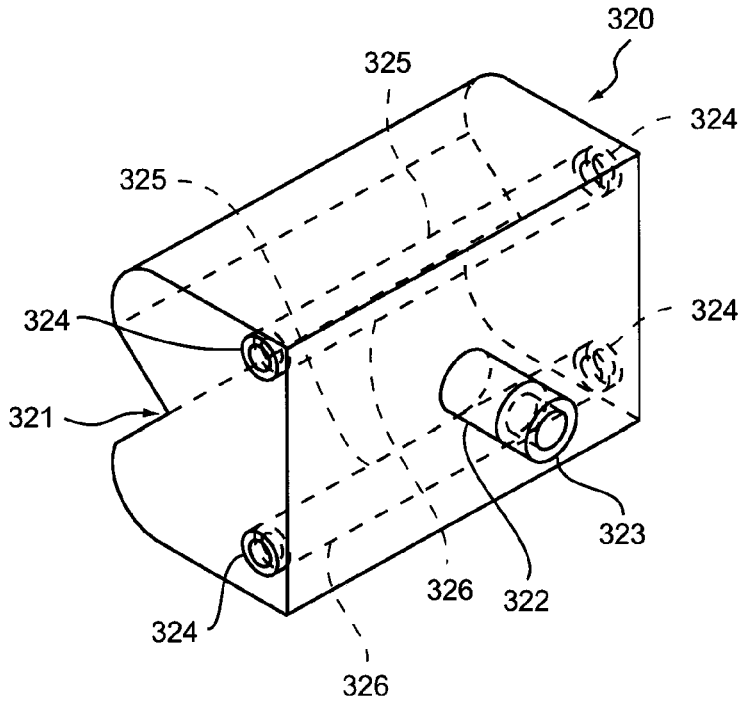
FIG. 26 is a schematic illustrating a perspective view of a shuttle member of the third embodiment of a reciprocal drive mechanism in another view angle.

FIG. 25 is a schematic illustrating a perspective view of details of the shuttle member 320, the shuttle inner arm 340 and an arm shaft 326. FIG. 26 is a schematic illustrating a perspective view of the shuttle member 320 seen from the guide member 350. The shuttle member 320 has a groove 321, a transmission rod 322, a roller 323, bearings 324 and shaft holes 325. Each shuttle inner arm 340 has an arm pin 341 and an arm hole 342. The four shuttle inner arms 340 are rotatably set to the shuttle member 320 via bearings 324 and shaft holes 325 of the shuttle member 320 and the arm shaft 326 penetrating the arm holes 342 of the shuttle inner arms 340. Since structures and functions of the groove 321, the transmission rod 322, the roller 323 are equivalent to those of the groove 321, the transmission rod 222, the roller 223 shown in FIG. 19 and FIG. 20, the details are not explained.

Figure 27:
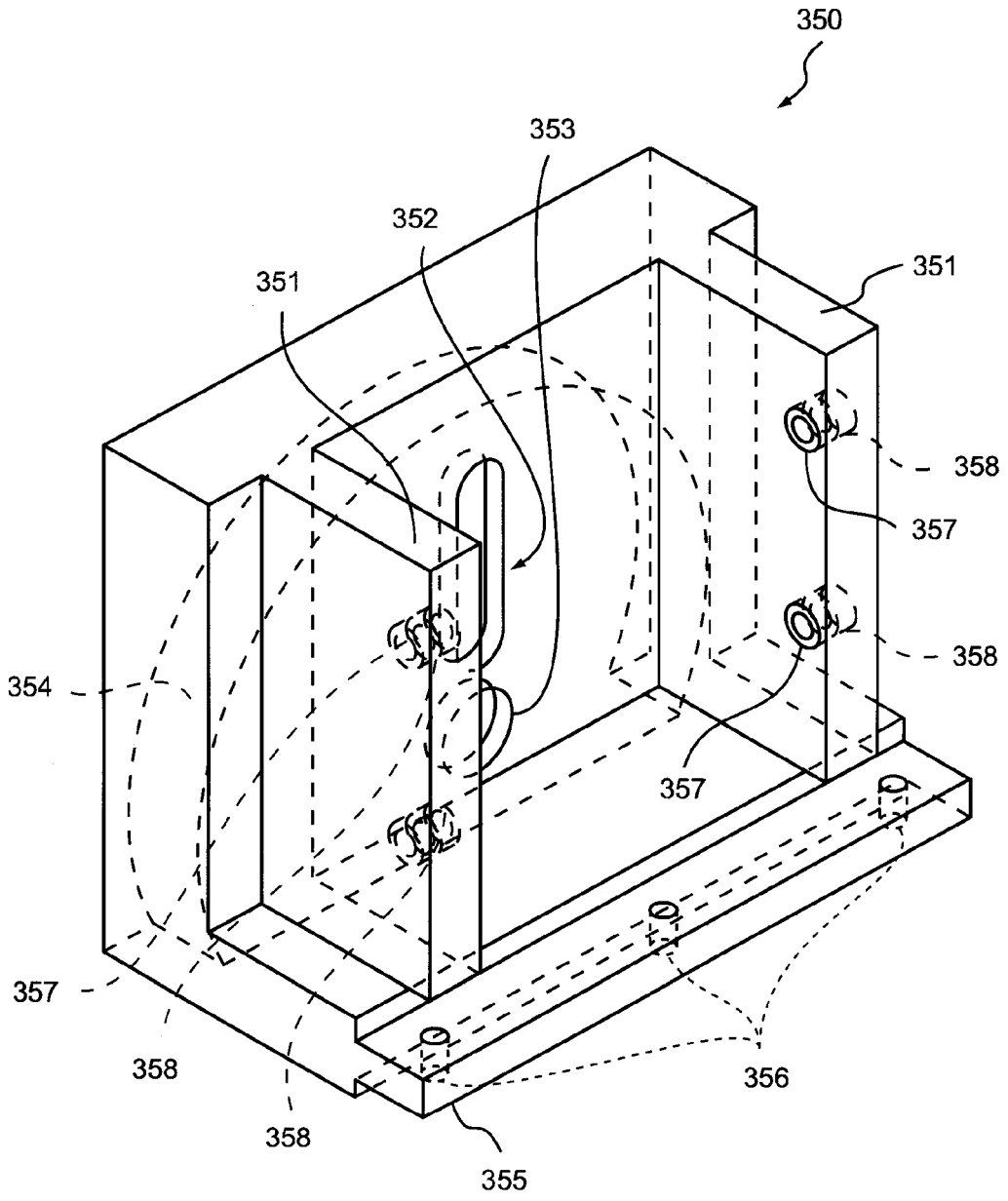
FIG. 27 is a schematic illustrating a perspective view of a guide member of the third embodiment of a reciprocal drive mechanism.

FIG. 27 is a schematic illustrating a perspective view of the guide member 350. The guide of the third embodiment of a reciprocal drive mechanism. The guide member 350 has two arm setting walls 351, the opening 352, a cam shaft bearing 353, a cam hall 354, bolt through-holes 356 and a base coupling tab 355. The bolt through-holes 356 are made in the base coupling tab 355. Each of the two arm setting walls 351 has a pair of bearings 357 and support holes 358.

The shuttle inner arms 340 are rotatably set to bearings 357 mounted in support holes 358 drilled in the arm setting walls 351. In the opposite side of the shuttle inner arm 340 against the arm pin 341, the shuttle member 320 are rotatably jointed via an arm hole 342 and a bearing 324 set in the shuttle member 320, wherein the shuttle inner arms 340 are fixed to an arm shaft 326. By using this structure, the four shuttle inner arms 340 attached to the shuttle member 320 and the arm setting walls 351 to which the four shuttle inner arms 340 are attached create the trajectory of the shuttle member 320 that can reciprocally move and scoot to the shuttle member 310.

The four shuttle inner arms 340 are rotatably set to the shuttle member 320 and the guide member 350 at the each end in a way that the shuttle member 320 can have parallel motion and move-in one against the shuttle member 310. The reciprocal motion of the shuttle member 320 can synchronously make the shuttle motion and move-in motion, that is vertical to the direction along the tube to be deformed by the shuttle mechanism, against the shuttle member 310.

Since the opening 352, a cam shaft bearing 353, a cam hall 354, a base coupling tab 355, bolt through-holes 356, the rotary cam 160 and the motor 170 have the same functions as those explained in the first embodiment of the reciprocal derive mechanism, detail explanation is omitted.

For this embodiment, the reciprocal motion made by the shuttle inner arm 340 provide the operative function such that when the shuttle member 320 vertically moves in accordance to the rotation of the rotary cam 160, the shuttle member 320 non-parallely scoots to the shuttle member 310 and makes tube squeezing motion (not shown in the figures). The shuttle inner arm 340 creates the trajectory of motion of the shuttle member 320.

The four shuttle inner arms 340 are rotatably linked to the shuttle members 320 and the arm setting walls 351. Each of the linkage of the four shuttle inner arms 340 is parallel to the others. Therefore, the shuttle member 320 can scoot in the shuttle member 310 in parallel to the shuttle members 310 and the shuttle members 320 and 310 deform the tube. The opposing surfaces of the shuttle members 320 and 310 are kept in parallel while shuttle members 320 and 310 deform the tube.

A pair of the shuttle inner arms 340 (one in upper side and the other in lower side) set in one side of the shuttle member 320 is preferably non-parallel. In this case, the shuttle member 320 non-parallely scoots into the shuttle member 310 and the shuttle members 320 and 310 deform the tube. If the surfaces of the groove 311 and 321 of the shuttle members 310 and 320, respectively, have bumps (such as the bump 25 35 and 45 as shown in FIGS. 6(*a*) to 6(*c*), FIGS. 7(*a*) to 7(*c*) and FIGS. 8(*a*) to 8(*c*), respectively), it is possible to move the bump in the right angle to the contact surface between the bump and the tube in such a motion that the shuttle member 320 can scoot the shuttle member 310.

In this embodiment, the shuttle member 320 has the bearing 324 and shaft hole 325 and the guide member 350 has two pairs of bearings 357 and the support holes 358. The bearings 324 and the bearings 357, for which ball bearings or oil metal bearings are preferably used, reduce the rotational friction of the shuttle inner arms 340 and smoothen the motion thereof. The bearings 324 and the bearings 357 reduce the allowance between the groove 311 of the shuttle member 310 and the groove 321 of the shuttle member 320 can be reduced so that the discharge volume of the liquid that is squeezed in the tube can be constant. Therefore the pumping volume of the pumps of the present invention can be consistent in time passing.

(An Embodiment of Whole Pump Mechanism Including Valves)

Figure 28:
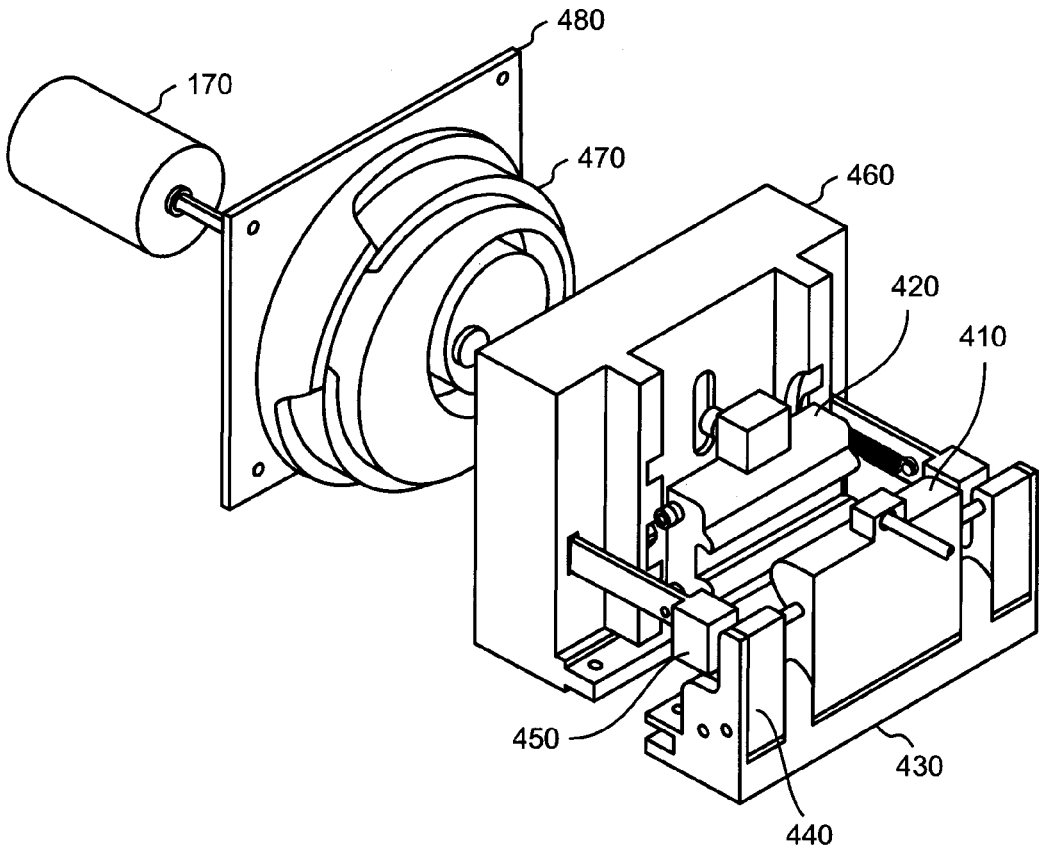
FIG. 28 is a schematic illustrating a perspective view of a pumping apparatus that includes a valve mechanism.

FIG. 28 is a schematic illustrating a perspective view of a pumping apparatus that includes a valve mechanism. The present pumping apparatus comprises a shuttle members 410 and 420, a shuttle base 430, a striker 440, valve plungers 450, a guide member 460, a rotary cam 470, a back plate and a motor 170. At the both sides of the shuttle members 410 and 420 along longitudinal direction of the tube, the pumping apparatus has valve plungers 450 that occlude and relieve the tube. The rotary cam 470 has an outer periphery (more specifically a plunger guiding inner brim 474 and a plunger guiding outer brim 475 (see FIG. 35)). The pumping apparatus has two pair of the valve plunger 450 and the striker 440, each of which constructs a valve means (called "valve" hereinafter, for the sake of simplicity) that occludes and relieves the tube.

The present embodiment shown in FIG. 28 has two differences from the second embodiment shown in FIG. 16 to FIG. 21. The first difference is that the valve plunger 450 that occludes and relieves the tube at the upper stream and the downstream of the shuttle mechanism in synchronous to the motion of the shuttle mechanism is driven by the rotary cam 470 in such a way so that the occlusion and the relief of the tube is synchronized to the shuttle motion of the shuttle mechanism to transport the fluid filled in the inner space of the tube from the upper stream side and the downstream side. On the other hand, the embodiments, one shown in FIG. 8 to FIG. 15, another FIG. 16 to FIG. 21 and the other FIG. 22 to FIG. 27, the valves are preferred to function in a different mechanism from the present embodiment. The second difference is that the shuttle member 420 in the shuttle mechanism that is a means to deform the tube has a different shape from that of other embodiment. For the shape of the shuttle member 420, the shape designed for the fourth embodiment of the present invention as shown in FIGS. 7(*a*) to 7(*c*) is adopted.

Figure 29:
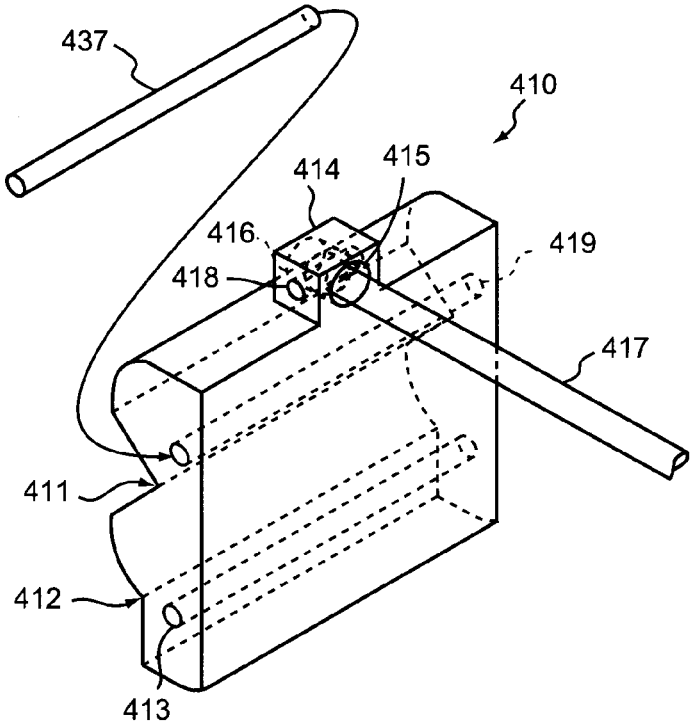
FIG. 29 is a schematic illustrating a perspective view of detail structure of a shuttle member and shuttle opening rod in a pumping apparatus.

FIG. 29 is a schematic illustrating a perspective view of detail structure of a shuttle member 410 and a shuttle opening rod 417 in the present pumping apparatus. The shuttle member 410 has a groove 411, foot portions 412, mounting holes 413 and a coupling box 414. The coupling box 414 has a rod joint hole 415 and a rod joint pin holes 416 and a shuttle opening rod 417, which has a ball tip 418, is fitted into the coupling box 414. The shuttle member 410 has a link rod hole 419 to which a link rod 437 is inserted.

Figure 30:
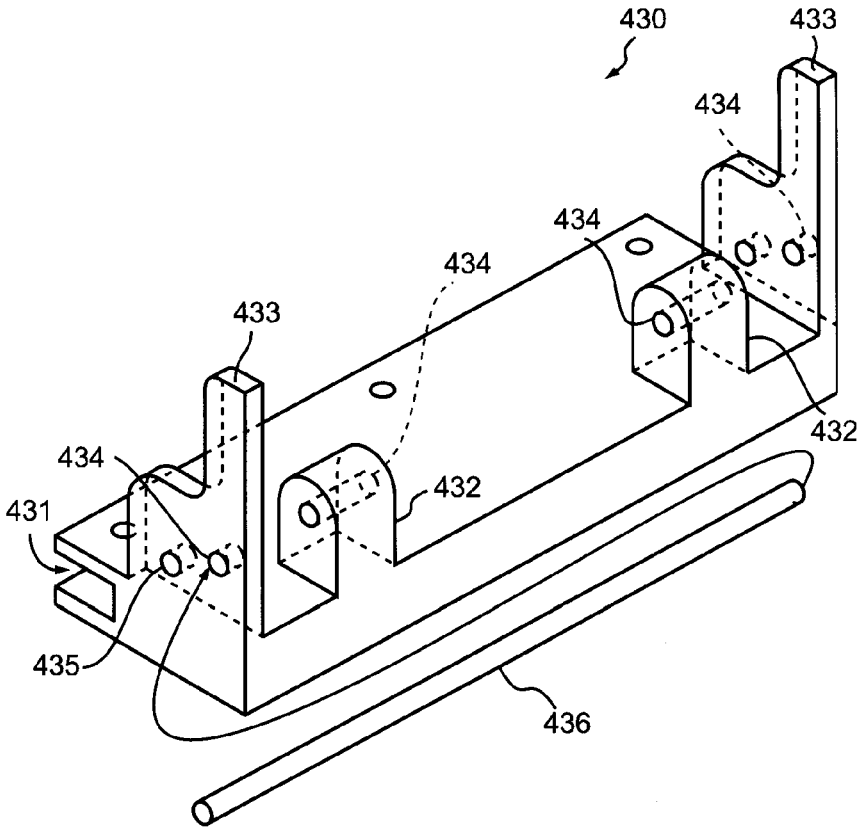
FIG. 30 is a schematic illustrating a perspective view of detail assembly structure of a shuttle base and a hinge rod in a pumping apparatus.

The shuttle member 410 is set to a shuttle member mounting stand 432 on a shuttle base 430 via a mounting hole 413 made in a foot portion 412 (see FIG. 30). The shuttle member is rotatably mounted to the shuttle member mounting stand 432. By rotating the shuttle member 410 with external force transmitted via the shuttle opening rod 417 and a coupling box 414, the shuttle member 410 can open or close against the shuttle member 420 in a hinge motion. The shuttle opening rod 417, of which tip has a ball tip 418, is fitted into the coupling box 414 receives. The ball tip 418 is inserted into the rod joint hole 415 and jointed to the coupling box 414 with joint pin holes 416 to be set in joint hole 415 so that the shuttle member 410 can rotate in some extent within the plane including the shuttle opening rod 417 and a smooth opening of the shuttle member 410 to insert/release the tube into/from the shuttle mechanism is allowed.

FIG. 30 is a schematic illustrating a perspective view of detail assembly structure of the shuttle base 430 and the hinge rod 436 in the present pumping apparatus. The shuttle base 430 has a coupling groove 431 that is to combine the shuttle base 430 with a guide member 460 to which the shuttle base 430 is combined with bolt to reduce looseness therebetween. The shuttle member mounting stands 432 and striker supporting stands 433 have rod penetrating holes 434 and the shuttle member 410 is set to the shuttle base 430 by a hinge rod 436. The striker supporting stands 433 have striker mounting holes 435 that fix valve stands 441 (see FIG. 31), being a part of the striker 440, to the shuttle base 430.

Figure 31:
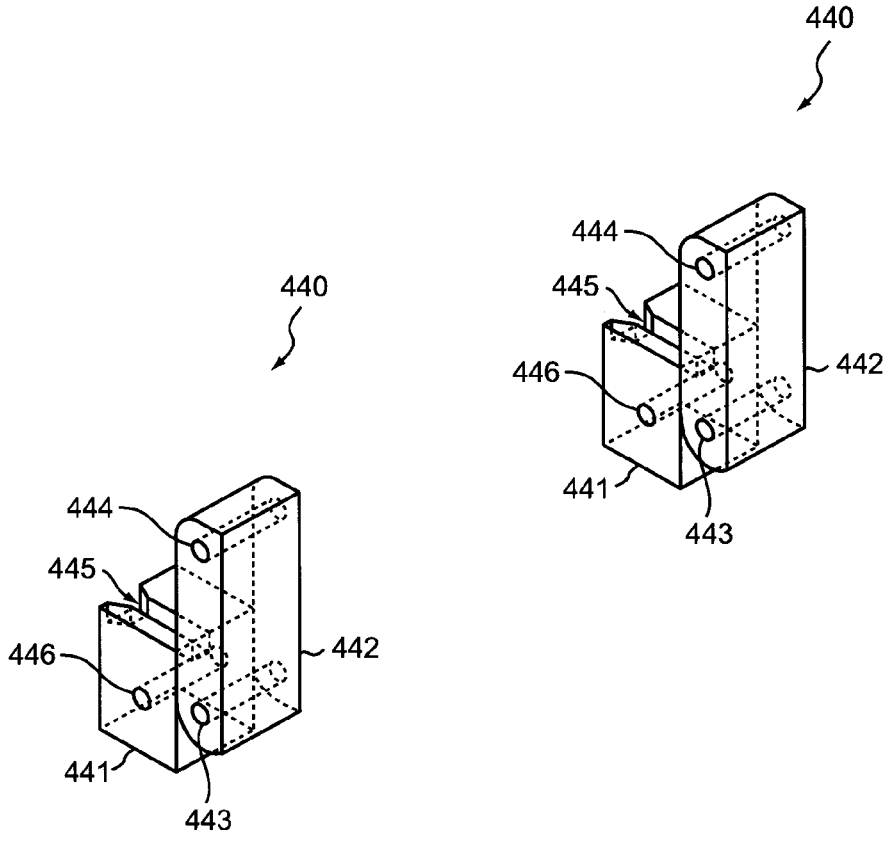
FIG. 31 is an magnified schematic illustrating a perspective view of detail structure of strike stands in a pumping apparatus.

FIG. 31 is a magnified schematic illustrating a perspective view of detail structure of the striker 440 in a pumping apparatus. In FIG. 31, the view is magnified to clearly show the details of the structure thereof. The strikers 440 have the valve stands 441 and that guide the valve plungers 450 and striker blocks 442 to which the valve heads 451 of the valve plungers 450 are pushed (see FIG. 33). The tube is set between the striker blocks 442 and the valve heads 451. The valve heads occlude and relieve the tube. The valve stands 441 have plunger guiding grooves 445 that guide the valve heads 451 and mounting holes 446. The striker blocks 442 have mounting holes 443 and link rod holes 444.

The valve stands 441 are rotatably engaged to the shuttle member mounting stands 432 of the shuttle base 430 and striker supporting stands 433 by the hinge rod 436 that is inserted into the mounting holes 446 (see FIG. 30). The two striker blocks 442 are linked with a link rod 437 inserted in the link rod holes 419 of the shuttle member 410.

Though the valve stands 441 are fixed to the shuttle base 430, the striker blocks 442 can pivot with the hinge rod 436. Therefore the lower part of the striker blocks 442 has a shape of a quarter of a circle to pivot with the mounting hole 443 slipping on the contact surface with the valve stands 441.

The structural combination of the shuttle member 410, the shuttle base 430 and the striker 440 enables to exchange the tube in the shuttle mechanism. In order to set a tube into the shuttle mechanism or replace with a new tube therein, the shuttle opening rod 417 is pulled to open the upper side of the shuttle member 410 and to insert the tube into or take it out from the space between the groove 411 of the shuttle members 410 and the groove 421 of the shuttle member 420 (see FIG. 32). Since the striker blocks 442 that composes valve mechanism is linked with the shuttle member 410 by the link rod 437, the striker blocks 442 open the upper side as well as the shuttle member 410 opens the upper side thereof. Therefore the tube can be removed from or inserted in the spaces between the striker blocks 442 and the valve heads 451 of the valve plungers 450. After setting the tube in such spaces, the shuttle opening rod 417 is pushed back to vertically set the shuttle member 410 up so that the shuttle member 410 closes the upper side thereof. At the same time, the striker blocks 442 is vertically set closing with the shuttle member 410 by the link rod 437 so that the shuttle member 410 closes the upper side thereof and the tube is completely set in the valve mechanism.

In order to keep the shuttle member 410 and the striker blocks 442 closing, the shuttle opening rod 417 is preferably held on by another means (not shown in the figures) or the striker block 442 is preferably held on with combining with such means or with an independent means.

Figure 32:
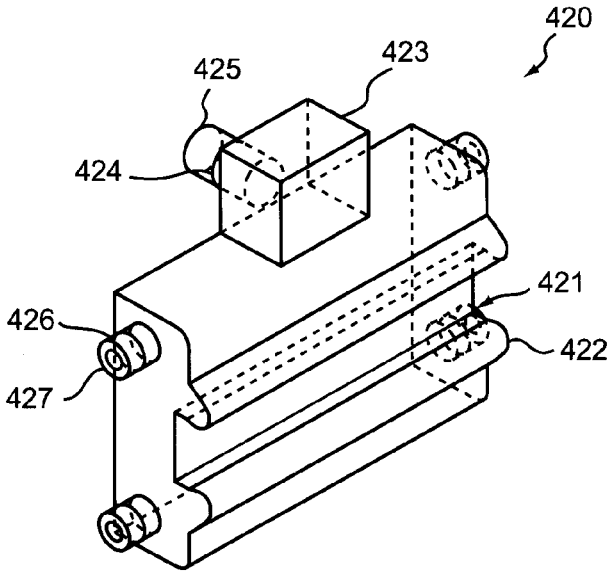
FIG. 32 is a schematic illustrating a perspective view of detail structure and construction of a shuttle member in a pumping apparatus.

FIG. 32 is a schematic illustrating a perspective view of detail structure and construction of a shuttle member 420 in the present embodiment of a pumping apparatus. The fundamental structure of the shuttle member 420, comprising a groove 421 and bumps 422, is same as that of the fourth embodiment shown in FIGS. 7(*a*) to 7(*c*). The shuttle member 420 has a transmission block 423 to which a transmission rod 424 and a roller 425 are set. The shuttle member 420 has guiding rods 426 and shuttle rollers 427.

The groove 421 and the bumps 422 construct a tube squeezing mechanism with the groove 411 of the shuttle member 410 (see FIG. 29) opposing to the shuttle member 420. In order to generate upward and downward reciprocal motion with little allowance necessary for squeezing the tube, the transmission rod 424 transmits upward and downward reciprocal motion generated by a rotary cam 470 and a guide member 460 to the shuttle member 420. The roller 425 can be a ball bearing or another antifriction bearing. The transmission rod 424 is linked to the transmission block 423 and the upward and downward reciprocal motion transmitted via the transmission rod 424 is transmitted to whole of the shuttle member 420.

Two of the guiding rod 426, of which tip has the shuttle roller 427, are attached to each side of the shuttle member 420. A trajectory of the motion necessary for the shuttle member 420 to scoot into the shuttle member 410 is created by the guiding rods 426, the shuttle rollers 427 and a shuttle motion guiding groove 467 formed in the guide member 460 (see FIG. 34).

Figure 33:
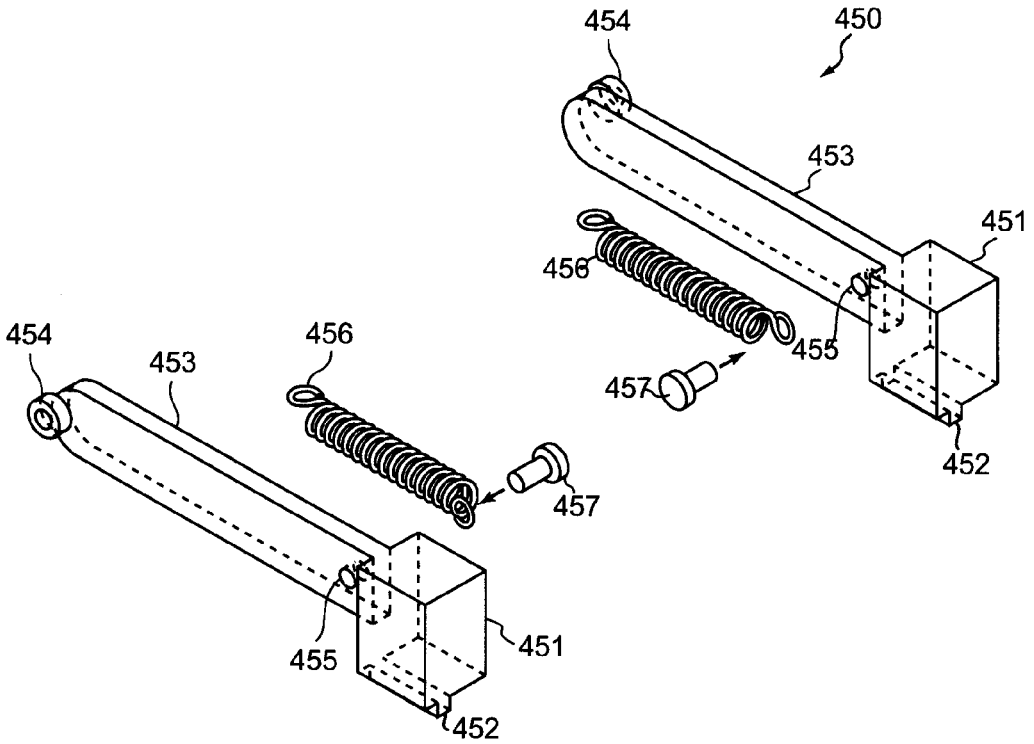
FIG. 33 is a schematic illustrating a perspective view of detail assembly structure of valve plungers in a pumping apparatus.

FIG. 33 is a schematic illustrating a perspective view of detail assembly structure of valve plungers 450 in a pumping apparatus. The valve plunger 450 has the valve head 451, a valve head guide 452, a transmission slab 453 and a cam roller 454. The transmission slab 453 has a pin hole 455 to which a pin 457 is inserted and a coil spring 456 is hooked to the pin 457.

The valve head 451 occludes and relieves the tube in the space made with the striker block 442. Tracing plunger guiding grooves 445 formed in the valve stands 441, the valve head guides 452 guide the vale head 451. The valve head 451 is attached to one end of the transmission slab 453 and a cam roller 454 to the other end. The cam roller 454 is engaged with the rotary cam 470 for which the spring force of the coil spring 456 supports such engagement. The motion of the valve plunger 450 generated by the rotation of the rotary cam 470 has a consistent relation with the reciprocal motion by the reciprocal drive mechanism of the present pumping apparatus so that the valve heads 451 occlude and relieve the tube in the portions of the upper stream and the downstream and the liquid filled in the tube can be transported from the upper stream to the downstream.

Figure 34:
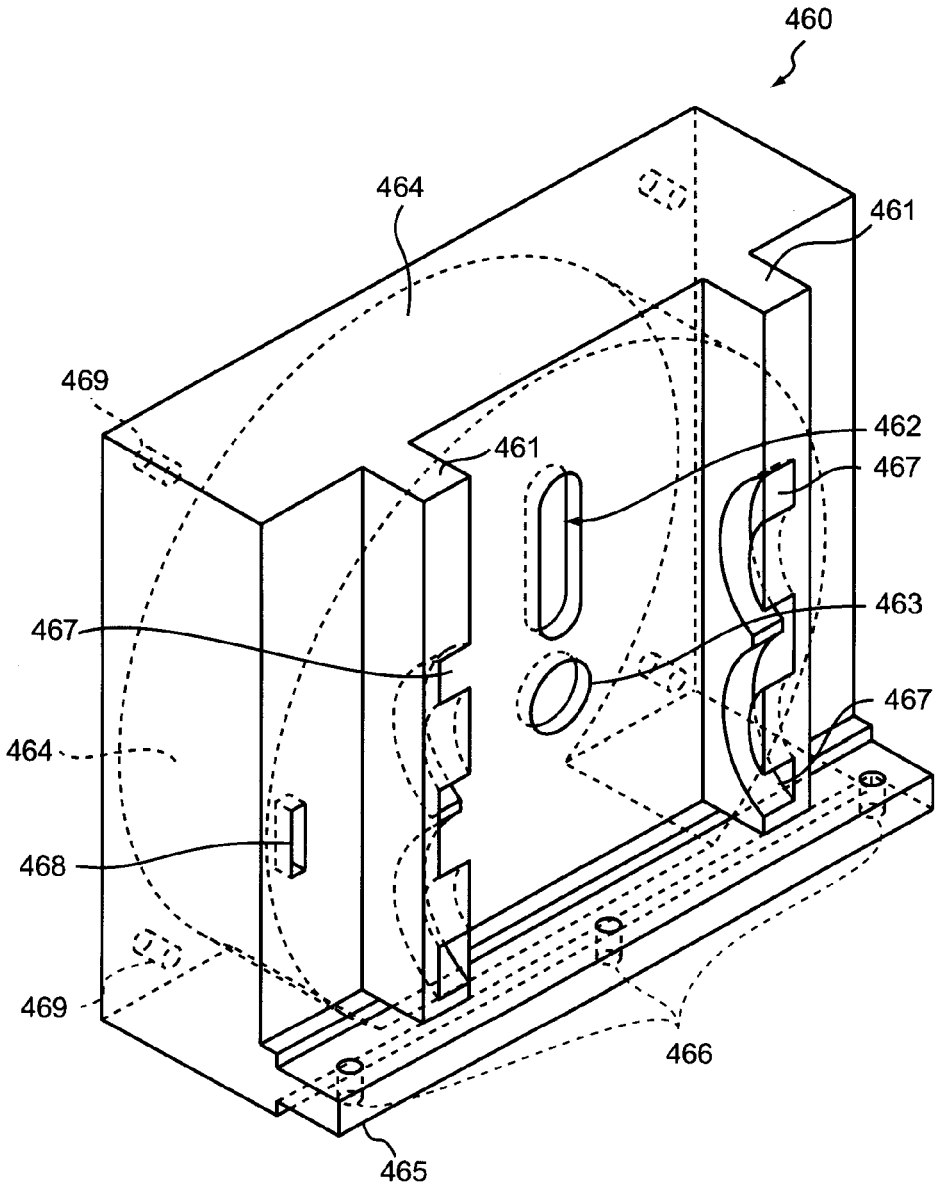
FIG. 34 is a schematic illustrating a perspective view of detail structure of a guide member in a pumping apparatus.

FIG. 34 is a schematic illustrating a perspective view of detail structure of a guide member 460 in a pumping apparatus. The guide member 460 is a member that guides the motion of one of shuttle members 410 and 420 (the shuttle member 420 for the present embodiment) against the other wherein the guide member 460 converts the rotational motion of the rotary cam 470, to the upward and downward reciprocal motion necessary for tube squeezing motion. The guide member 460 has two guiding walls 461, an opening 462, a cam shaft bearing 463, a cam hall 464 and a base coupling tab 465. Bolt through-holes 466 are made in the base coupling tab 465. Each of the two guiding walls 461 has the shuttle motion guiding groove 467. The guide member 460 also has plunger trough-holes 468 and screw holes 469.

The shuttle rollers 427 attached to the shuttle member 420 are engaged with the shuttle motion guiding grooves 467. The guiding rod 426 and the shuttle rollers 427 that are guided by the shuttle motion guiding grooves 467 work as a means that the shuttle members 420 reciprocally moves in parallel with an opposing surface of the shuttle member 410 and moves in a move-in motion that is vertical to both the longitudinal direction of the tube and the direction of such reciprocal motion of the shuttle member 420. The two guiding walls 461 confine the whole motion of the shuttle member 420 in the lateral direction (that is, the longitudinal direction of the tube). The shuttle motion guiding grooves 467 controls the route of the motion of the shuttle member 420 such that tube squeezing motion is generated by the shuttle member 420 which can reciprocally move and scoot to the shuttle member 410.

Two shuttle motion guiding grooves 467, one formed in the upper part and the other lower part of the guiding walls 461 have identically same shape and dimensions. The separation distance between these two guiding grooves is identically same as that between the two shuttle rollers 427, one in the upper part and the other lower part of one side of the shuttle member 420. Due to such same separation distance, the groove 411 of the shuttle member 410 and the groove 421 and the bumps 422 of the shuttle member 420 are kept parallel during the tube squeezing motion.

By differentiating the separation distance between the two shuttle motion guiding grooves 467 from that between the two shuttle rollers 427, the shuttle member 420 can move against the shuttle member 410 in a non-parallel motion. For this structural relation of the separation distances, the shuttle member 420 non-parallely scoots to the shuttle member 410 and makes tube squeezing motion (not shown in figures). In other words, it is possible for the bump to scoot in a right angle to the contact surface between the bumps 422 and the tube so that the tube is rotated with the tube center axis in the tube longitudinal direction and squeezed by shuttle members 420 and 410. This rotation of the tube is effective for the infusion of nutritional supplements that easily forms colloidal aggregate. The rotation of the tube create a share stress to the colloidal aggregate so that the supplements are homogenized in the tube. This homogenization eliminates the agitation process of the infusion liquid for the purpose of homogenizing before infusion.

Ball bearings or oil-metal bearing are preferably used for the shuttle rollers 427 that move with tracing the shuttle motion guiding grooves 467 in order to realize being smoothly guided therein. By using these bearing components, the movement of the shuttle member 420 can be smoothened and the backlash between the bearing components and the shuttle motion guiding grooves 467 can be suppressed during reciprocal shift motion guided in the shuttle motion guiding grooves 467 so that the time-averaged discharging volume of the liquid that is squeezed in the tube can be constant. Therefore the pumping volume of the pumps of the present invention can be consistent in time passing.

The opening 462 formed in the guide member 460 regulates the motion of the transmission rod 424 of the shuttle member 420 of which tip is guided by the guiding cam trench 472 (see FIG. 35) of the rotary cam 470 to the upward and downward direction (see FIG. 32). The cam front shaft 471 of the rotary cam 470 is inserted into the cam shaft bearing 463 (see FIG. 35). The rotary cam 470 is set in the cam hall 464.

The base coupling tab 465 and the bolt through-holes 466 combine the guide member 460 and shuttle base 430 by inserting the base coupling tab 465 of the guide member 460 into the coupling groove 431 of the shuttle base 430 (see FIG. 30) and the guide member 460 and the shuttle base 430 are coupled by inserting bolts into both bolt through-holes 466 and those of the shuttle base 430.

The plunger through-holes 468 are the holes that the transmission slabs 453 of the valve plunger 450 penetrate the guide member 460 and can drive the valve plungers 450 in a reciprocal motion in accordance with the rotation of the rotary cam 470. A back plate 480 is set by bolts screwed into the screw holes 469 (not shown in figures).

Figure 35:
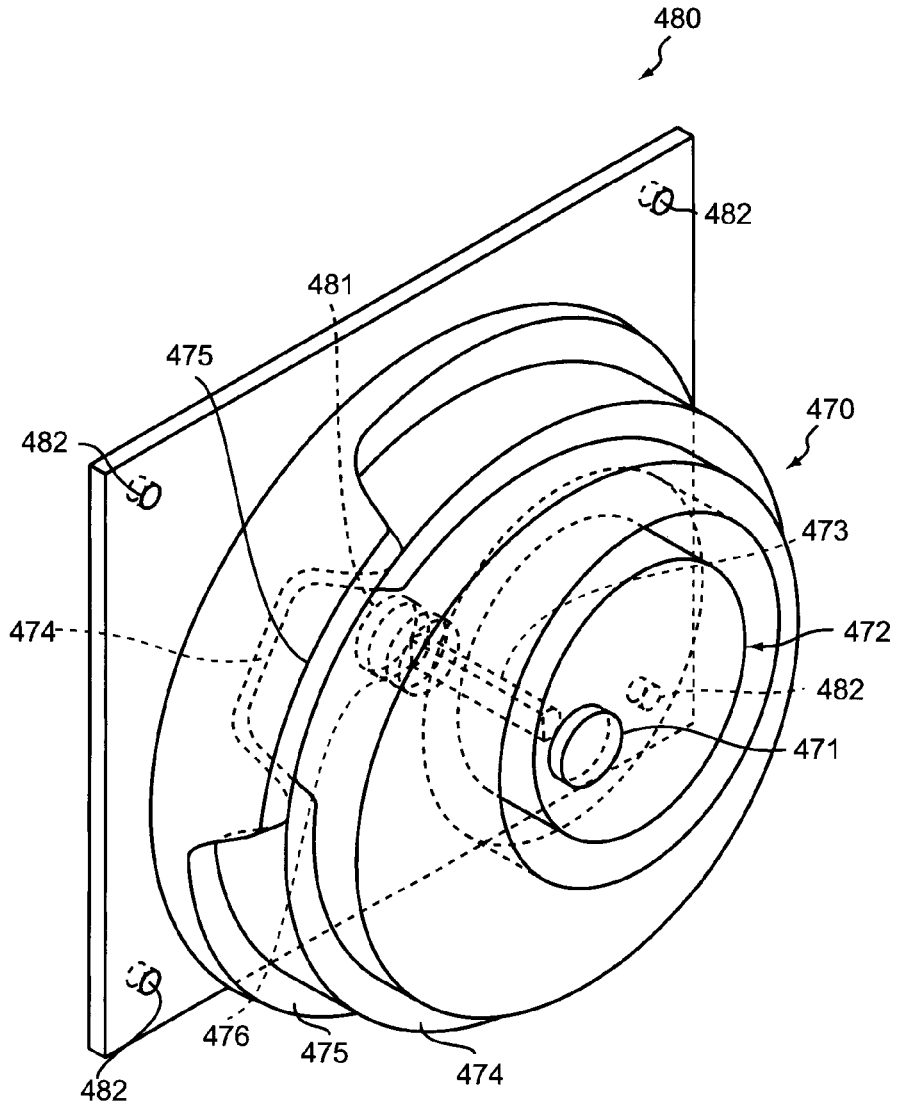
FIG. 35 is a schematic illustrating a perspective view of detail structure of a rotary cam and a back plate in a pumping apparatus.

FIG. 35 is a schematic illustrating a perspective view of detail structure of the rotary cam 470 and the back plate 480 in the present pumping apparatus. The rotary cam 470 has the rotary cam front shaft 471, the guiding cam trench 472, a motor shaft bearing hole 473, the plunger guiding inner brim 474, the plunger guiding outer brim 475 and a cam back shaft 476. The back plate 480 has a cam shaft bearing 481 and the back plate mounting holes 482.

The back plate 480 is fixed to the guide member 460 with bolts (not shown in the figures) screwed into the back plate mounting holes 482. By using the back plate 480 and the bolts, the rotary cam 470 is assembled in the guide member 460 wherein the cam front shaft 471 is set into the cam shaft bearing 463 of the guide member 460 (see FIG. 34) and the rotary cam 470 is rotatably set in the cam hall 464 (see FIG. 34). The transmission rod 424 of the shuttle member 420 (see FIG. 32) is inserted into the guiding cam trench 472 through the opening 462 (see FIG. 34) of the guide member 460. The plunger guiding inner brim 474, the plunger guiding outer brim 475, with which the cam rollers 454 of the valve plungers 450 are engaged, are formed in an outer perimeter of the rotary cam 470 (see FIG. 33). The cam back shaft 476 is engaged with the cam shaft bearing 481 made in the back plate 480 and can freely rotate therein.

The guiding cam trench 472 is eccentrically formed to the rotation center determined by the motor shaft hole made in the rotary cam 470. The roller 425 of the shuttle member 420 trace the guiding cam trench 472 and the motion of the transmission rod 424 of the shuttle member 420 is regulated by the opening 462 made in the guide member 460. Due to this construction, the rotational motion of the rotary cam 470 is converted to the upward and downward reciprocal motion of the shuttle member 420. This upward and downward motion of the shuttle member 420 is further converted into the tube squeezing motion of the shuttle member 420 by the guiding walls 461, a shuttle motion guiding groove 467, the transmission rod 424 and the rollers 425.

The plunger guiding inner brim 474 or the plunger guiding outer brim 475 and the guiding cam trench 472 have an invariable relation in the angular position against the revolution of the rotary cam 470. Due to this invariable relation, the motion of the valve plunger 450 generated by the rotation of the rotary cam 470 has an invariable relation with the reciprocal motion of the reciprocal drive mechanism. The liquid in the tube can be transported from the upper stream to the downstream thereof by the valve plungers 450 that occlude and relieve the tube in the upper stream and the downstream.

The details of the motion of the valve plunger 450 that is created by the plunger guiding inner brim 474 and the plunger guiding outer brim 475 formed in the rotary cam 470 is discussed in the followings. The valve plungers 450 are put to penetrate the plunger through-holes 468 (see FIG. 34) before setting the cam roller 454 thereto. The valve plungers 450 are pulled to the guide member 460 by the coil springs 456 so that the valve plungers 450 vertically trace the surfaces in the right angle to rotation axes of the plunger guiding inner brim 474 and the plunger guiding outer brim 475. When the shuttle member 420 squeezes the tube in accordance with the rotation of the rotary cam 470, the valve plunger 450 that traces the plunger guiding inner brim 474 is pushed to the striker 440 so that the upper stream of the tube is occluded. As the result, the valve head 451 is pushed to the striker block 442. Furthermore, the other valve plunger 450 that traces the plunger guiding outer brim 475 of the rotary cam 470 is pulled back from the striker 440 so that the downstream of the tube is relieved. The force of the valve plunger 450 is generated by the coil spring 456. When the shuttle member 420 brings the tube back to the original shape, the valve plunger 450 that traces the plunger guiding outer brim 475 is pulled back from the striker 440 so that the upper stream of the tube is relieved. As the result, the valve head 451 is pulled back from the striker block 442. The force of the valve plunger 450 is generated by the coil spring 456. Furthermore, the other valve plunger 450 that traces the plunger guiding inner brim 474 of the rotary cam 470 is pushed to the striker 440 so that the downstream of the tube is occluded. As the result, the valve head 451 is pushed to the striker block 442.

Figure 36:
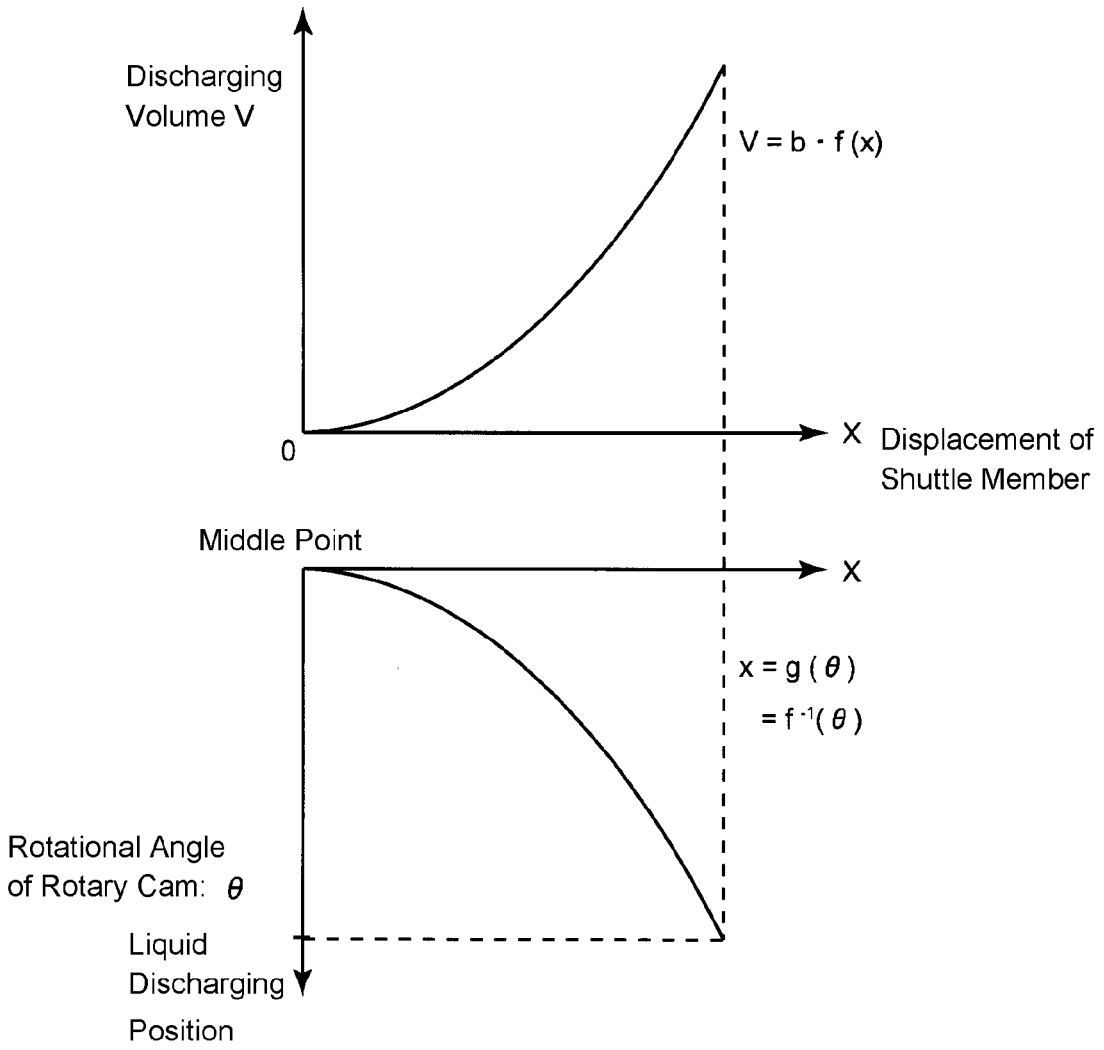
FIG. 36 is a diagram that shows a relation between discharging volume V of fluid and rotational angle of a rotary cam.
Figure 37:
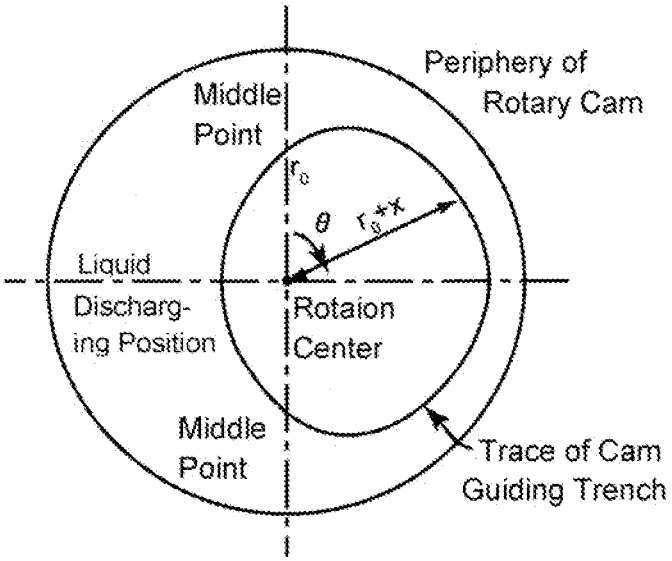
FIG. 37 is a diagram that shows an example of the relation between an outer circumference and a trace of a guiding cam trench.
Figure 38:
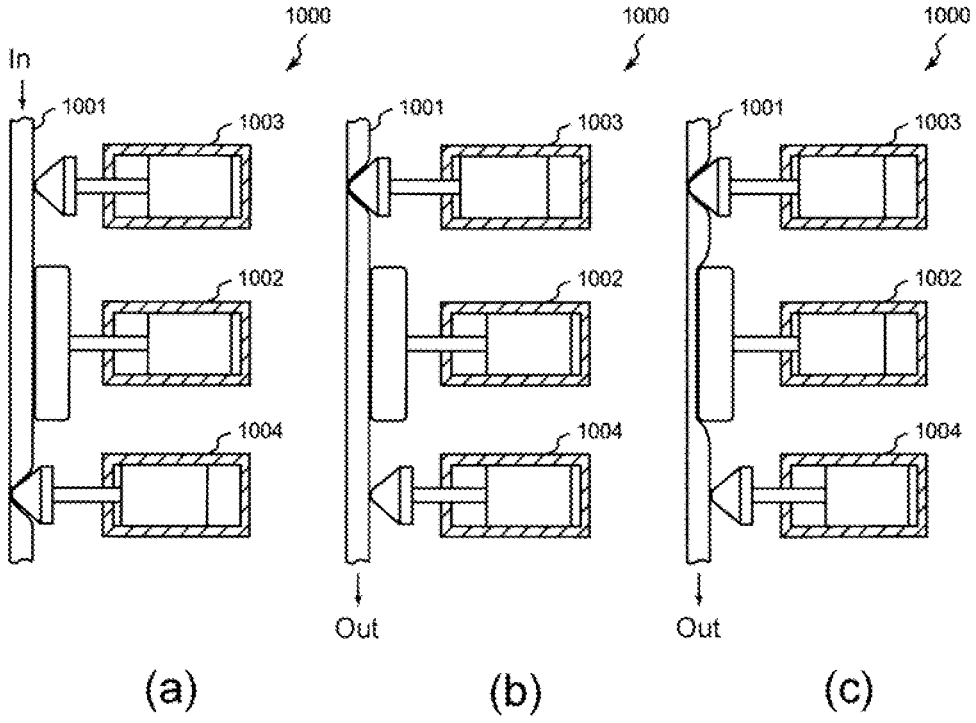
FIG. 38(*a*) is a schematic illustrating a principle of pump operation of a conventional pump wherein the inlet valve mechanism relieves the inlet side of the tube, the outlet valve mechanism occludes the outlet side of the tube and the shuttle mechanism relieves the deformation of the tube to fill the fluid in the pump region of the tube.
Figure 39:
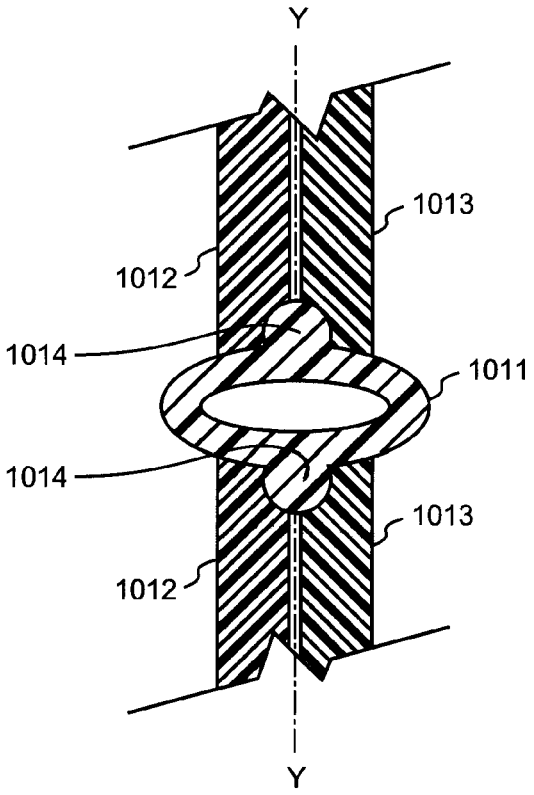
FIG. 39 is a schematic illustrating a cross-sectional view of an example of shuttle mechanism adopted in a prior art.
Figure 40:
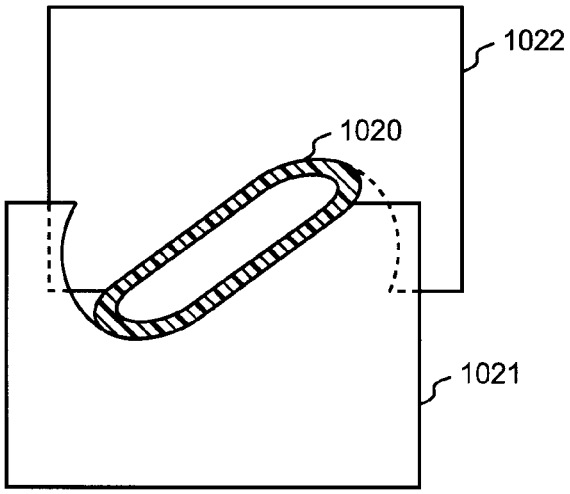
FIG. 40 is a schematic illustrating a cross-sectional view of another example of a prior art of shuttle mechanisms.

FIG. 36 shows a diagram that shows a relation between discharging volume V of fluid and rotational angle θ of a rotary cam. Assuming discharging volume V of a shuttle pump against displacement x between the mutually opposing shuttle members 110 and 120, 210 and 220, 310 and 320 or 410 and 420 is given by $$V=b\cdot f(x),$$

where f(x) is a function to convert the displacement x to the discharging volume V as shown in the upper diagram shown in FIG. 36. On the other hand, the shape of the guiding cam trench 162 or 472 is designed so that the displacement x is given by $$x=g(\theta)=f^{-1}(\theta),$$

where, $f^{-1}(\theta)$ denotes a reverse function of the function $f(\theta)$. The equations x=0 for the shuttle members 110 and 120, 210 and 220, 310 and 320 and 410 and 420 implies the displacement x that is the displacement between the shuttle members 11 and 12, 21 and 22, 31 and 32 and 41 and 42 at liquid holding positions shown in FIG. 1(*a*), FIG. 5(*a*), FIG. 6(*a*) and FIG. 7(*a*), respectively. According to the shape of the guiding cam trench 162 or 472, it is possible to discharge the liquid filled in the tube in a constant speed because $$\begin{aligned} V &= b\cdot f(f^{-1}(\theta)) \\ &= b\cdot\theta, \end{aligned}$$

is satisfied. This equation implies the discharging volume is proportional to the rotational angle θ of the rotary cam from the liquid holding position and b is a constant. FIG. 37 shows an example of a diagram that provides an example of the relation between an outline of outer circumference of a rotary cam and a trace of a guiding cam trench thereof. In this diagram, two crossover points of the abscissa and the trace of the cam guiding trench present two liquid discharging positions that a pair of shuttle members 110 and 120, 210 and 220, 310 and 320 or 410 and 420 (or from a view of more theoretical aspect, shuttle members 11 and 12, 21 and 22, 31 and 32 or 41 and 42) has and two crossover points (described as "middle point" in FIG. 37) of the axis of an ordinate and the trace of the cam guiding trench does two liquid holding positions.

In the above discussion, we have explained some of the embodiments of the present invention. The present invention is not limited within the embodiments as illustrated in the above explanations and drawings. The modification in the range of the same concept of the present invention and those which have combinations of plurality of the elements regarding these inventions in an appropriate method are included as a same or an equivalent invention thereto. The some of the elements in the above embodiments can be omitted form the implementation without departing from the scope of the present invention.

In the above explanations and embodiments, one of two shuttle members is not driven by external drive mechanisms. Since two shuttle members relatively move to squeeze the tube and therefore two shuttle members may be movable against a base to which these two shuttle members are fixed.

REFERENCE NUMERALS

11, 12, 21, 22, 31, 32, 41, 42, 110, 120, 210, 220, 310, 320, 410, 420: shuttle member
13, 14, 23, 24, 33, 34, 43, 44, 111, 121, 211, 221, 321, 411, 421: groove
25, 35, 45, 422: bump
15, 16, 17, 18, 46, 47, 48, 49: folding portion
112, 125, 324, 357: bearing
113, 126, 325: shaft hole
114, 469: screw hole
122: guiding groove
123, 222, 322, 424: transmission rod
124, 223, 322, 425: roller
130: shuttle arm
140, 230, 330, 430: shuttle base
141, 231, 431: coupling groove
142, 143, 156, 234, 246, 356, 466: bolt through-hole
150, 240, 350, 460: guide member
151: guiding rail
152, 242, 352, 462: opening
153, 243, 353, 463, 481: cam shaft bearing
154, 244, 354, 464: cam hall
155, 245, 355, 465: base coupling tab
160, 470: rotary cam
161: cam shaft
162, 472: guiding cam trench
163, 473: motor shaft bearing hole
170: motor
171: main motor unit
172: motor shaft
173: motor bearing
180, 250, 360: tube deforming groove
212, 312, 412: foot portion
213, 313 413, 443, 446: mounting hole
214, 314, 414: coupling box
215, 315, 415: rod joint hole
216, 316, 416: rod joint pin hole
217, 317, 417: shuttle opening rod
218, 318, 418: ball tip
224, 426: guiding rod
225, 427: shuttle roller
232, 432: shuttle member mounting stands
233: mounting stand hole
241, 461: guiding wall
247, 467: shuttle motion guiding grooves
326: arm shaft
340: shuttle inner arm
341: arm pin
342: arm hole
351: arm setting wall
358: support hole
419, 444: link rod hole
423: transmission block
433: striker supporting stand
434: rod penetration hole
435: striker mounting hole

436: hinge rod
437: link rod
440: striker
441: valve stand
442: striker block
445: plunger guiding groove
450: valve plunger
451: valve head
452: valve head guide
453: transmission slab
454: cam roller
455: pin hole
456: coil spring
457: pin
468: plunger through-hole
469: screw hole
471: cam front shaft
474: plunger guiding inner brim
475: plunger guiding outer brim
476: cam back shaft
480: back plate
482: back plate mounting hole
1000: shuttle pump
1001, 1020: tube
1011: specially-shaped tube
1002: shuttle mechanism
1003: inlet valve mechanism
1004: outlet valve mechanism
1012, 1013: jaw member
1014: ridge part
1021, 1022: member The present application claims priority to Japanese Patent Application No. 2011-197874, filed Sep. 12, 2011, the disclosure of which is incorporated herein by reference in its entirety.

What is claimed is:

1. A pumping apparatus comprising:

two single-piece opposing members that are set along a longitudinal direction of a tube made of an elastic material such that the two opposing members oppose each other across the tube, wherein each of the opposing members has a groove whose shape does not change during operation, and the grooves meet to form a space that holds the tube in a cross section thereof, wherein the two opposing members in their entirety have reciprocal motion across a liquid holding position in which the tube in the space is full of liquid and between two liquid discharging positions in which the liquid is discharged from the tube due to deformation of a cross sectional shape of the tube, wherein the reciprocal motion includes a combined shuttle and move-in motion by which at least one of the two opposing members moves in an arc toward the other opposing member such that a part surrounding the groove of one of the opposing members moves into an inner space of the groove of the other opposing member.

2. The pumping apparatus according to claim 1, further comprising a reciprocal drive mechanism that realizes the reciprocal motion.

3. The pumping apparatus according to claim 1, wherein the liquid holding position is a center position between the two liquid discharging positions.

4. The pumping apparatus according to claim 1, wherein the grooves have substantially same triangular shapes for cross sections thereof and form a hollow that has a substantially square shape for cross section and side section along the tube when the grooves meet.

5. The pumping apparatus according to claim 4, wherein at least one of the grooves has a bump on a surface thereof in order to deform cross sectional area of the tube to be shrunk.

6. The pumping apparatus according to claim 1, wherein one of the two opposing members has a groove which has substantially triangular shape for cross section thereof and the other of the two opposing members has two bumps and a groove which separates the two bumps.

7. The pumping apparatus according to claim 1, wherein the reciprocal motion further includes a rotational motion by which at least one of the two opposing members moves with a rotational component in a plane vertical to an axis extending in the longitudinal direction.

8. The pumping apparatus according to claim 2, wherein the reciprocal drive mechanism has four arms of substantially same shape that link the two opposing members to each other via four joints in a linkage such that each of the four arms is attached to the two opposing members to be rotatable in a surface vertical to the longitudinal direction of the tube and the two opposing members have the reciprocal motion across the liquid holding position and between the two liquid discharging positions.

9. The pumping apparatus according to claim 2, wherein the reciprocal drive mechanism has a guiding member that guides one of the two opposing members in a motion to the other opposing member with a guidance such that the guiding member has guiding trenches into which guiding rods attached to one of the two opposing members are put to trace thereof and the two opposing members have the reciprocal motion across the liquid holding position and between the two liquid discharging positions.

10. The pumping apparatus according to claim 9, wherein the guiding rods have rollers therearound to smoothly trace the guiding trenches.

11. The pumping apparatus according to claim 9, wherein the other opposing member is mounted to a supporting member which has an axle parallel to surface thereof and the other opposing member turns around the axle in a surface vertical to longitudinal direction of the tube in a hinge motion against one of the opposing members to open or close the space that holds the tube in a cross section thereof.

12. The pumping apparatus according to claim 2, wherein the reciprocal drive mechanism has a guiding member to which one of the two opposing members with four arms via joints is linked in a linkage such that each of the four arms are rotatable in a surface vertical to longitudinal direction of the tube and the two opposing members have the reciprocal motion across the liquid holding position and between the two liquid discharging positions.

13. The pumping apparatus according to claim 2, wherein the reciprocal drive mechanism comprises a transmission rod that is attached onto a reverse side of one of the opposing members facing to the other one of the opposing members, a guiding member that has an opening and a rotary cam being held therein and driven by a motor, that has a trench eccentrically made to rotational axis thereof, wherein the transmission rod is put in the trench through the opening by which rotational motion of the rotary cam is converted to linear motion to generate reciprocal motion of one of the opposing members movable against the other one of the opposing members.

14. The pumping apparatus according to claim 13, further comprising valve means that are placed both sides of the reciprocal drive mechanism and occlude and relieve the tube, wherein a periphery of the rotary cam has guiding trenches that control the valve means to synchronously occlude and relieve the tube to the reciprocal motion.

15. A pumping apparatus comprising:

valve means that occlude and relieve a tube made of an elastic material in at least two positions; and pressing means that are placed between the two positions of the tube and press the tube such that a cross sectional shape of the tube is deformed thereby, wherein the pressing means has two single-piece opposing members opposing across the tube along a longitudinal direction of the tube, wherein each of the two opposing members has a groove whose shape does not change during operation, and the grooves meet to form a space that holds the tube in a cross section thereof, wherein the two opposing members in their entirety have reciprocal motion across a liquid holding position in which the tube in the space is full of liquid and between two liquid discharging positions in which the liquid is discharged from the tube due to deformation of a cross sectional shape of the tube, wherein the reciprocal motion includes a combined shuttle and move-in motion by which at least one of the two opposing members moves in an arc toward the other opposing member such that a part surrounding the groove of one of the opposing members moves into an inner space of the groove of the other opposing member.

16. The pumping apparatus according to claim 15, wherein the reciprocal motion further includes a rotational motion by which at least one of the two opposing members moves with a rotational component in a plane vertical to an axis extending in the longitudinal direction.

* * * * *